US011127544B2

(12) United States Patent
Yaginuma

(10) Patent No.: US 11,127,544 B2
(45) Date of Patent: Sep. 21, 2021

(54) SPRING AND SWITCH

(71) Applicants: CITIZEN ELECTRONICS CO., LTD., Yamanashi (JP); CITIZEN WATCH CO., LTD., Tokyo (JP)

(72) Inventor: Yoshihiro Yaginuma, Fujiyoshida (JP)

(73) Assignees: CITIZEN ELECTRONICS CO., LTD., Yamanashi (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 17/055,071

(22) PCT Filed: Feb. 14, 2020

(86) PCT No.: PCT/JP2020/005882

§ 371 (c)(1),
(2) Date: Nov. 12, 2020

(87) PCT Pub. No.: WO2020/170987

PCT Pub. Date: Aug. 27, 2020

(65) Prior Publication Data

US 2021/0217564 A1 Jul. 15, 2021

(30) Foreign Application Priority Data

Feb. 18, 2019 (JP) ..... JP2019-026763
May 31, 2019 (JP) ..... JP2019-102921

(51) Int. Cl.
*H01H 13/48* (2006.01)
*H01H 11/04* (2006.01)
(Continued)

(52) U.S. Cl.
CPC ..... *H01H 13/48* (2013.01); *H01H 5/20* (2013.01); *H01H 11/04* (2013.01); *H01H 13/52* (2013.01)

(58) Field of Classification Search
CPC ..... H01H 13/52; H01H 13/14; H01H 13/48; H01H 13/10; H01H 2013/525;
(Continued)

(56) References Cited

U.S. PATENT DOCUMENTS 6,784,382 B2 * 8/2004 Yanai ..... H01H 13/44 200/1 B
2007/0102272 A1 * 5/2007 Sano ..... H01H 13/48 200/310
(Continued)

FOREIGN PATENT DOCUMENTS

CN 202839391 U 3/2013
CN 203415458 U 1/2014
(Continued)

OTHER PUBLICATIONS

International Search Report and Written Opinion for related JP App. No. PCT/JP2020/005882 dated Apr. 14, 2020; 2 pages.

*Primary Examiner* — Ahmed M Saeed
(74) *Attorney, Agent, or Firm* — Procopio, Cory, Hargreaves & Savitch LLP

(57) ABSTRACT

A spring has a dome portion having a dome shape bulging convexly, an outer peripheral portion disposed along the entire periphery of the dome portion, first and second support portions disposed at both ends of the outer peripheral portion, a valley bending portion disposed between the dome portion and the outer peripheral portion, and bent concavely upward, a first crest bending portion disposed between the outer peripheral portion and the first support portion, and bent convexly upward, and a second crest bending portion disposed between the outer peripheral portion and the second support portion, and bent convexly upward, wherein the outer peripheral portion includes a first and second side end portions which are not connected with the first and second support portions, and the valley bending
(Continued)

portion disposed between the dome portion and the first and second side end portions extends linearly or curved inwardly in a longitudinal direction.

15 Claims, 21 Drawing Sheets

(51) Int. Cl.
*H01H 5/20* (2006.01)
*H01H 13/52* (2006.01)

(58) Field of Classification Search
CPC .. H01H 2215/004; H01H 13/20; H01H 13/12; H01H 13/7073; H01H 13/30; H01H 11/04
See application file for complete search history.

(56) References Cited

U.S. PATENT DOCUMENTS

| | | | | |
|---|---|---|---|---|
| 2017/0033070 | A1 | 2/2017 | Betsui et al. | |
| 2018/0218854 | A1* | 8/2018 | Miyamoto | H01H 13/04 |
| 2018/0218856 | A1* | 8/2018 | Ito | H01H 13/52 |

FOREIGN PATENT DOCUMENTS

| | | | |
|---|---|---|---|
| CN | 106024469 | A | 10/2016 |
| CN | 107452533 | A | 12/2017 |
| JP | 2007035304 | A | 2/2007 |
| JP | 3178218 | U | 9/2012 |
| JP | 2016181365 | A | 10/2016 |
| JP | 2017204456 | | 11/2017 |
| JP | 2019008947 | A | 1/2019 |
| KR | 1020160114500 | A | 1/2016 |

* cited by examiner

SPRING AND SWITCH

FIELD

This disclosure relates to a spring and a switch.

BACKGROUND

A push-type switch is known in which a spring which reverses in response to a pressing of a dome portion is used as a movable contact. A spring used as a movable contact for a push-type switch is also referred to as a tact spring. In a push-type switch, the dome portion of the spring is pressed and reversed to contact a fixed contact disposed on a substrate, thereby turning the switch on. Further, the dome portion of the spring is not pressed, and separates from the fixed contact disposed on the substrate, the switch is turned off.

Since a spring is formed by punching the coil material, when the spring is formed by punching the coil material, fractured surfaces are formed on the outer peripheral portion of the spring. Cracks may be formed toward the inside of the spring of the switch from the outer peripheral portion in which fractured surface is formed, by applying stresses to the outer peripheral portion, each time the reverse operation by pressing is performed.

Various techniques are known for preventing cracks from being formed inward from the outer peripheral portion of the spring. For example, in JP 2016-181365 (hereinafter, also referred to as Patent Document 1), it is described that protrusions extend in two places along the longitudinal direction of the dome portion in a spring across the central portion of the dome portion. Since the spring described in Patent Document 1 has protrusions extending in two places along the longitudinal direction of the dome portion across the central portion of the dome portion, the concentration of internal stress at the outer peripheral end may be reduced, and therefore the occurrence of cracks in the outer peripheral end portion is reduced, and thereby prolonging the life time of the spring.

SUMMARY

However, the manufacturing cost of the spring described in Patent Document 1 may be increased, since the step of forming the protrusion becomes complicated.

The object of the present disclosure is to provide a spring that may be easily manufactured and have high durable.

The spring according to the present disclosure has a dome portion having a dome shape bulging convexly toward the upward, an outer peripheral portion disposed along the entire periphery of the dome portion, first and second support portions disposed at both ends of the outer peripheral portion, a valley bending portion disposed between the dome portion and the outer peripheral portion, and bent concavely upward, a first crest bending portion disposed between the outer peripheral portion and the first support portion, and bent convexly upward, and a second crest bending portion disposed between the outer peripheral portion and the second support portion, and bent convexly upward, wherein the outer peripheral portion includes first and second side end portions which are not connected with the first and second support portions, and the valley bending portion disposed between the dome portion and the first and second side end portions extends linearly or curved inwardly in a longitudinal direction.

In the spring according to the present disclosure, it is preferable that the outer edges of the first and second side end portions extend linearly or curved outwardly in a longitudinal direction, and when the outer edges of the first and second side end portions extend curved outwardly, the curvatures of the outer edges of the first and second side end portions are larger than the curvature of the virtual circle in contact with at least 3 points of the outer edge of the spring.

In the spring according to the present disclosure, it is preferable that the valley bending portion is disposed between the dome portion and the first and second side end portions extends linearly in a longitudinal direction.

In the spring according to the present disclosure, it is preferable that the valley bending portion is disposed between the dome portion and the first and second side end portions extends curved inwardly in a longitudinal direction.

In the spring according to the present disclosure, it is preferable that the outer edges of the first and second side end portions extend linearly in a lateral direction of the spring.

In the spring according to the present disclosure, it is preferable that the valley bending portion is disposed between the dome portion and the first and second side end portions extends curved outwardly in the lateral direction of the spring.

In the spring according to the present disclosure, it is preferable that the valley bending portion is disposed between the dome portion and the first and second side end portions extends linearly in the lateral direction of the spring.

In the spring according to the present disclosure, it is preferable that the valley bending portion disposed between the dome portion and the first and second side end portions extends is curved inwardly in the lateral direction of the spring.

In the spring according to the present disclosure, it is preferable that the dome portion has a planar shape in which the end portions of straight lines forming a cross are connected by curves that curve inwardly.

In the spring according to the present disclosure, it is preferable that the valley bending portion includes lateral extensions extending in the lateral direction and longitudinal extensions extending in the longitudinal direction, and the lateral extensions extending and longitudinal extensions are not connect each other.

In the spring according to the present disclosure, it is preferable that the first and second support portions are disposed at both ends of the longitudinal direction of the spring, and the first and second side end portions are at the ends of the lateral direction of the spring.

In the spring according to the present disclosure, it is preferable that each of the first and second support portions has a protrusion disposed at the end of the longitudinal direction of the spring.

In the spring according to the present disclosure, it is preferable that a recess is formed on the dome portion.

In the spring according to the present disclosure, it is preferable that a through hole is formed on the dome portion.

The switch according to the present disclosure has a substrate, a first fixed contact disposed on the surface, a second fixed contact disposed so as to surround the first fixed contact, a spring disposed above the first fixed contact, and in contact with the second fixed contact at the longitudinal ends, a case disposed on the substrate, and formed a housing portion with the substrate in which the first fixed contact, the second fixed contact, the spring and presser are put, and a protective cover adhered to the surface of the case so as to cover the housing portion, wherein the spring has a dome portion having a dome shape bulging convexly toward the upward, an outer peripheral portion disposed along the entire periphery of the dome portion, a first support portion and a second support portion disposed at both ends of the outer peripheral portion, a valley bending portion disposed between the dome portion and the outer peripheral portion, and bent concavely upward, a first crest bending portion disposed between the outer peripheral portion and the first support portion, and bent convexly upward, and a second crest bending portion disposed between the outer peripheral portion and the second support portion, and bent convexly upward, wherein the outer peripheral portion includes a first side end portion and a second side end portion which are not connected with the first support portion and second support portion, and the valley bending portion disposed between the dome portion and the first and second side end portions extends linearly or curved inwardly in a longitudinal direction.

The spring according to the present disclosure may be easily manufactured and have high durability.

BRIEF DESCRIPTION OF THE DRAWINGS

FIG. 9C is a cross-sectional view of a state in which the switch shown in FIG. 8A is pressed;

DESCRIPTION OF EMBODIMENTS

Hereinafter, a switch having a spring and a spring according to one aspect of the present disclosure will be described with reference to figures. However, it should be noted that the technical scope of the present disclosure is not limited to those embodiments, but includes the claimed invention and its equivalents.

<Configuration and Function of the Switch Equipped with the Spring According to the First Embodiment>

Figure 1:
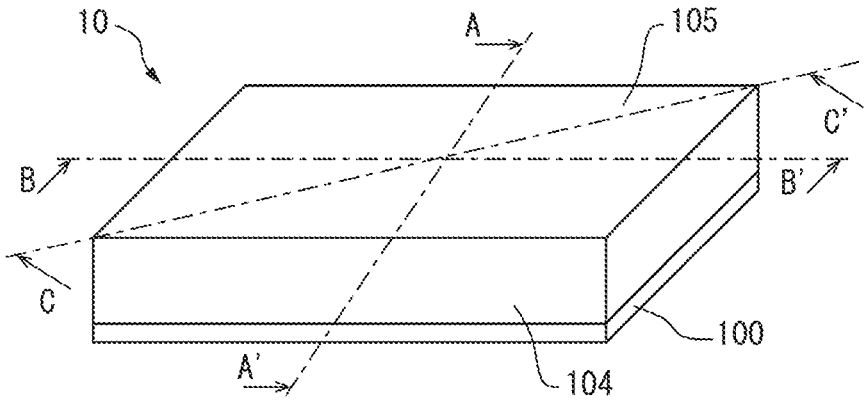
FIG. 1 is a perspective view of a switch mounted with a spring according to the first embodiment.
Figure 2B:
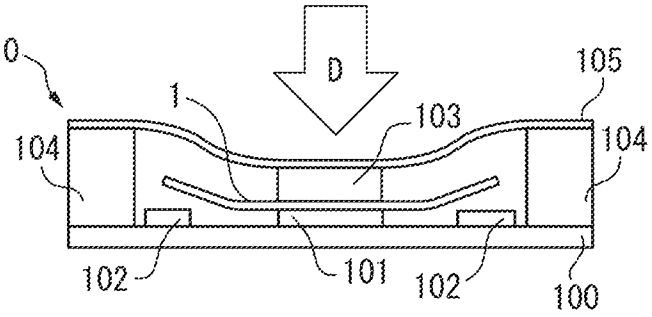
FIG. 2B is a sectional view along A-A' line shown in FIG. 1 in a state where the switch shown in FIG. 1 is pressed.
Figure 2D:
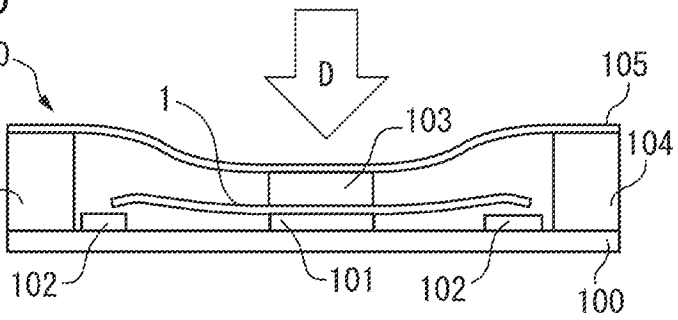
FIG. 2D is a sectional view along B-B' line shown in FIG. 1 in a state where the switch shown in FIG. 1 is pressed.
Figure 2F:
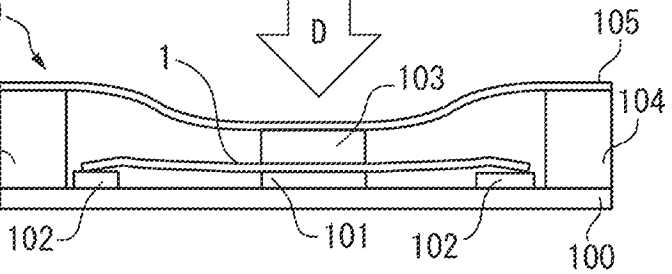
FIG. 2F is a sectional view along C-C' line shown in FIG. 1 in a state where the switch shown in FIG. 1.
Figure 2A:
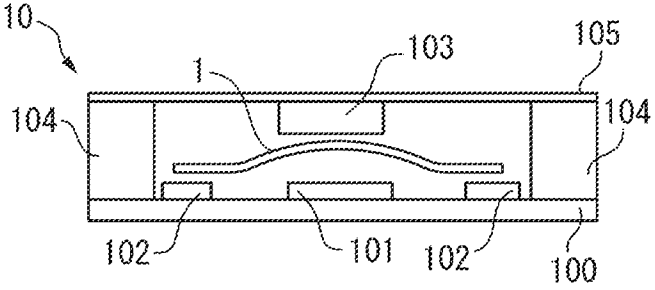
FIG. 2A is a sectional view along A-A' shown in FIG. 1.
Figure 2C:
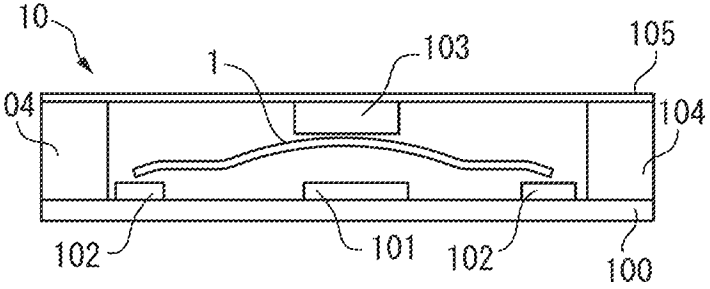
FIG. 2C is a sectional view along B-B' line shown in FIG. 1.
Figure 2E:
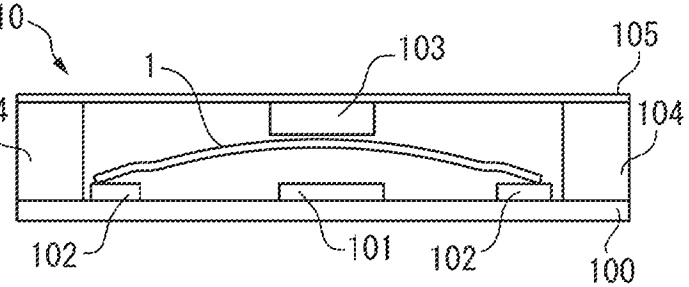
FIG. 2E is a sectional view along C-C' line shown in FIG. 1.
Figure 3:
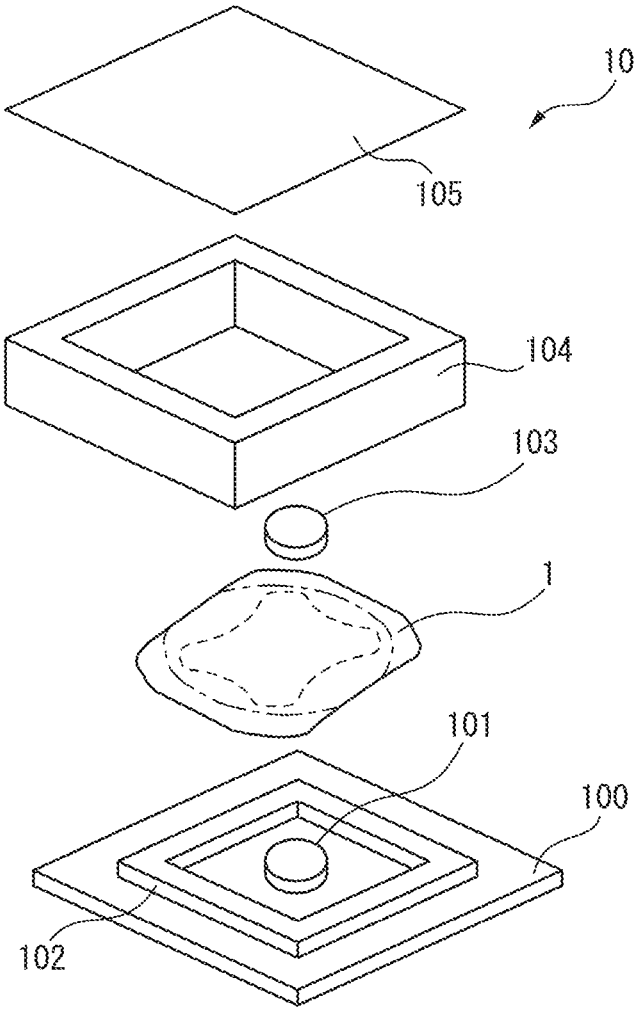
FIG. 3 is an exploded perspective view of a switch shown in FIG. 1.

FIG. 1 is a perspective view of a switch mounted with a spring according to the first embodiment. FIGS. 2A and 2B are a sectional view along A-A' shown in FIG. 1, FIGS. 2C and 2D are a sectional view along B-B' shown in FIG. 1, and FIGS. 2E and 2F is a sectional view along C-C' shown in FIG. 1. FIG. 3 is an exploded perspective view of the switch shown in FIG. 1. FIGS. 2B, 2D and 2F are a cross-sectional view of a state where the switch shown in each of FIGS. 2A, 2C and 2E is pressed.

The switch 10 has a substrate 100, a first fixed contact 101, a second fixed contact 102, a spring 1, a presser 103, a case 104, and a protective cover 105.

The substrate 100 is a flat plate-shaped member having a rectangular planar shape formed an insulating resin material, and the first fixed contact 101 and the second fixed contact 102 is disposed on the surface. A pair of electrodes electrically connected to each of the first fixed contact 101 and the second fixed contact 102 are disposed on the back surface of the substrate 100, and the switch 10 is connected to an external device such as a control device via a pair of electrodes disposed on the back surface of the substrate 100.

The first fixed contact 101 is a conductor having a circular planar shape disposed at the center of the surface of the substrate 100, and disposed below the top of the spring 1. The second fixed contact 102 is a conductor having a frame-shaped planar shape, and disposed on the surface of the substrate 100 so as to surround the first fixed contact 101.

The spring is a dome-shaped conductor top, and disposed so that the spring 1 is disposed above the first fixed contact 101, and the longitudinal end of the spring 1 is in contact with the second fixed contact 102. When the switch 10 is pressed from the surface direction, as indicated by the arrow D in FIGS. 2B, 2D and 2E, the top of the spring 1 is reversed in response to the press, and in contact with the first fixed contact. When the top of the spring 1 contacts with the first fixed contact 101, the first fixed contact 101 is conducted with the second fixed contact 102, and therefore the switch 10 is turned on. Further, when the top of the spring 1 is not pressed, the first fixed contact 101 is separated from the spring 1, and the first fixed contact 101 is separated from the second fixed contact 102, and therefore the switch 10 is turned off.

The presser 103 is formed of a cylindrical resin material, and disposed above the top of the spring 1. The operability of the pressing operation of the switch 10 is improved by placing the presser 103 in switch 10. In the switch according to the embodiment, the presser 103 may have a rectangular parallelepiped shape. Further, the presser 103 may be omitted.

The case 104 is a frame-shaped resin material, and formed a housing portion with the substrate 100 in which the first fixed contact 101, the second fixed contact 102, the spring 1 and presser 103 are put, by being disposed on the substrate 100. The case 104 is adhered to the surface of the substrate 100 via an adhesive member such as an adhesive bond and an adhesive sheet. Although the case has a frame shape in the embodiment, it may has elliptical shape.

The protective cover 105 is a sheet material formed of a synthetic resin having flexibility such as polyimide, and adhered to the surface of the case 104 so as to cover the housing portion formed by the substrate 100 and the case 104.

<Configuration and Function of the Spring According to the First Embodiment>

Figure 4B:
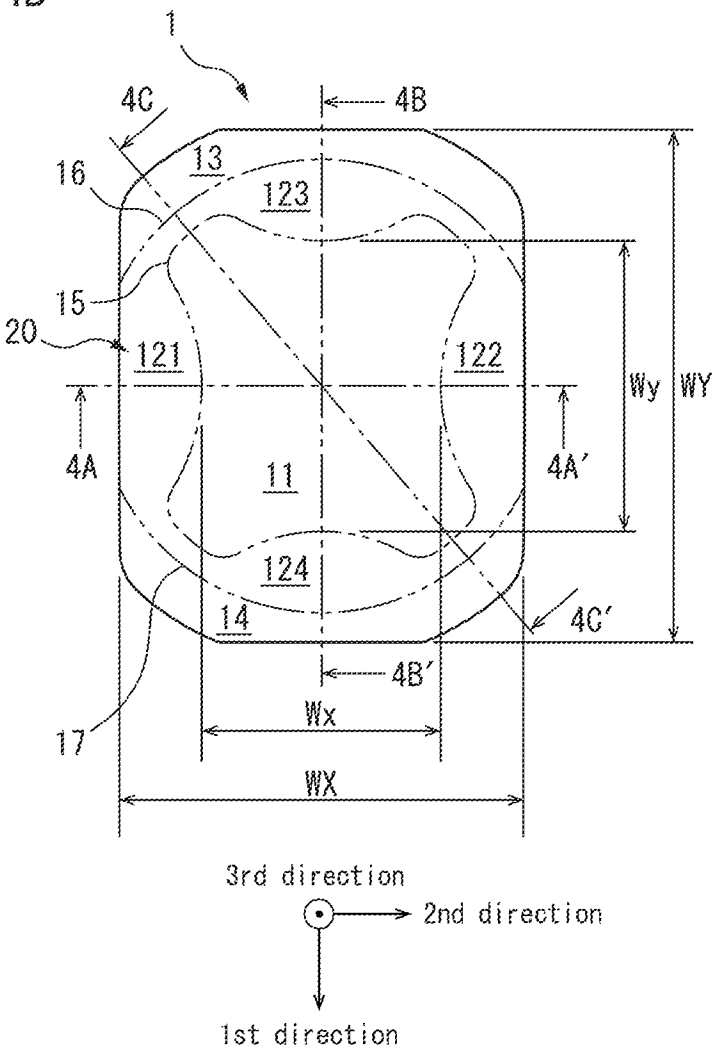
FIG. 4B is a plan view of the spring shown in FIG. 3.
Figure 4A:
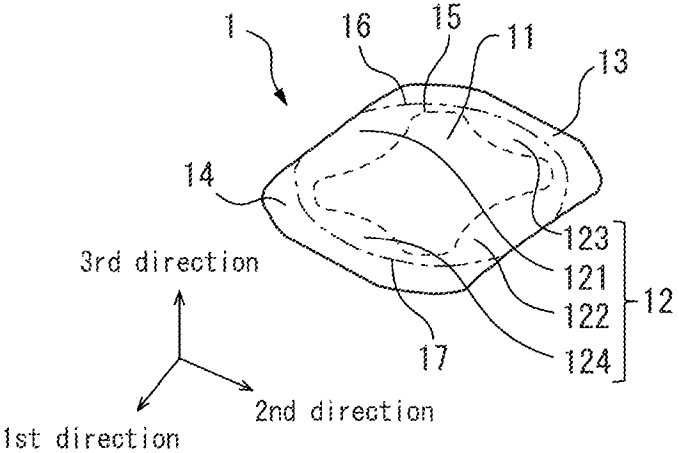
FIG. 4A is a perspective view of a spring shown in FIG. 3.
Figure 5A:
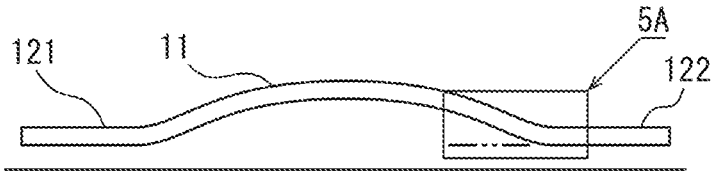
FIG. 5A is a cross-sectional view along 4A-4A' line shown in FIG. 4B.
Figure 5B:
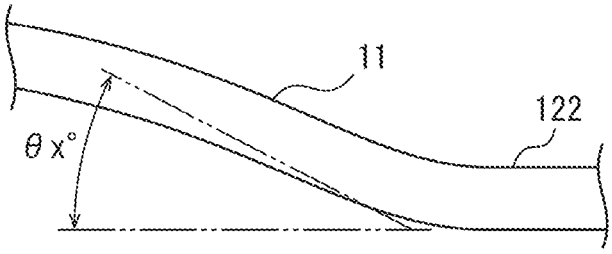
FIG. 5B is a partially enlarged view of a portion shown by an arrow 5A line in FIG. 5A.
Figure 5C:
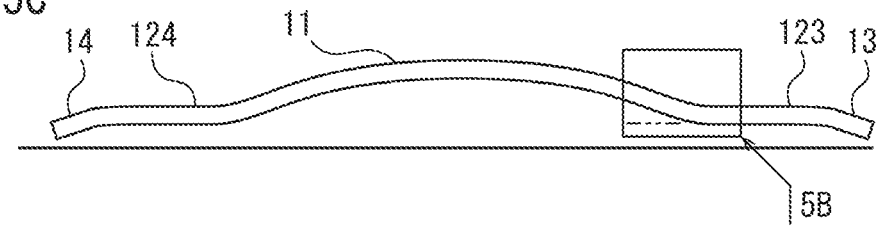
FIG. 5C is a cross-sectional view along a line 4B-4B' shown in FIG. 4B.
Figure 5D:
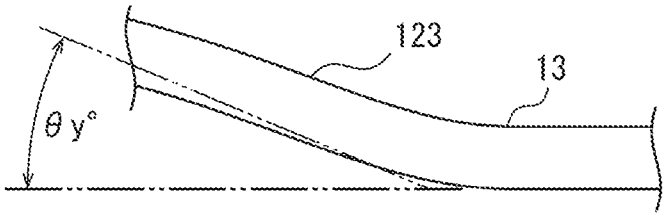
FIG. 5D is a partially enlarged view of a portion indicated by an arrow 5B line in FIG. 5C.
Figure 5E:
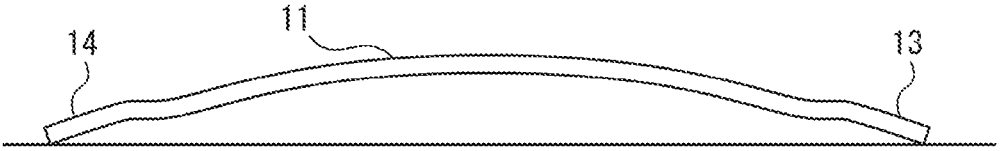
FIG. 5E is a cross-sectional view along a line 4C-4C' shown in FIG. 4B.

FIG. 4A is a perspective view of a spring 1, and FIG. 4B is a plan view of the spring 1. FIG. 5A is a cross-sectional view along 4A-4A' line shown in FIG. 4B, and FIG. 5B is a partially enlarged view of a portion shown by an arrow 5A line in FIG. 5A. FIG. 5C is a cross-sectional view along the line 4B-4B' shown in FIG. 4B, FIG. 5D is a partially enlarged view of a portion shown by an arrow 5B line in FIG. 5C, and FIG. 5E is a cross-sectional view along the line 4C-4C' shown in FIG. 4B.

The spring 1 has a dome portion 11, an outer peripheral portion 12, a first support portion 13, a second support portion 14, a valley bending portion 15, a first crest bending portion 16, and a second crest bending portion 17. The dome portion 11 has a dome shape in which the first direction i.e., a longitudinal direction of the dome portion 11 is longer than the second direction i.e., a lateral direction of the dome portion 11 perpendicular to the first direction, and the dome portion 11 bulges convexly toward the third direction is i.e., upward. The dome portion 11 has a planar shape in which the end portions of straight lines forming a cross are connected by curves that curve inwardly.

The outer peripheral portion 12 is disposed along the entire periphery of the dome portion 11 via the valley bending portion 15. The outer peripheral portion 12 has a first side end 121, a second side end 122, a first shoulder 123, and a second shoulder 124, and formed so as to extend in the horizontal direction.

The first side end 121 and the second side end 122 are disposed to extend in a first direction along the longitudinal direction of the dome portion 11 so as to include a side end of the spring 1. Each of the first side end portion 121 and the second side end portion 122 are disposed to include the side end of the spring 11, and therefore the first side end portion 121 and the second side end portion 122 are both ends in the second direction i.e., the lateral direction of the spring 11.

Further, the outer edge of the first side end portion 121 and the second side end portion 122 extend linearly in the first direction. Furthermore, the valley bending portion 15 formed between the first and second side end portion 121 and 122 and the dome portion 11 is curved inwardly and extends in the first direction.

The first shoulder 123 and the second shoulder 124 have an arc planar shape, and disposed on each of both ends of the dome portion 11 in the first direction via the valley bends 15 which are curved inwardly and extend in the second direction. Since the first shoulder 123 is disposed between the first side end 121 and the first support portion 13, the first side end 121 is not directly connected with the first support portion 13. Since the second shoulder 124 is disposed between the second side end 122 and the second support portion 14, the second side end 122 is not directly connected with the second support portion 14. The first shoulder 123, the second shoulder 124, the second side end 122, and the first shoulder 123 may be flat.

The first support portion 13 and the second support portion 14 are disposed at both ends in the first direction, i.e., the longitudinal direction of the outer peripheral portion 12 via each of the first crest bending portion 16 and the second crest bending portion 17. Each outer edges of the first support portion 13 and the second support portion 14 includes a portion extending linearly in the second direction, and portions curved in an arc shape from both ends of the portion extending linearly in the second direction.

The valley bending portion 15 is disposed between the dome portion 11 and the outer peripheral portion 12, and bent concavely upward. The second crest bending portion 17 is disposed between the outer peripheral portion 12 and the second support portion 14, and bent convexly upward. The angles θx and θy of valley bending portion 15 are 1° or more and 15° or less, in one aspect, they are 3°. Each of the angles θx and θy of valley bending portion 15 is an angle formed by the tangential direction of the outer edge of the dome portion 11 having a constant curvature and the horizontal direction.

The outer edge of the dome portion 11 is a portion where the curvature changes toward the first side end portion 121, the second side end portion 122, the first shoulder portion 123 and the second shoulder portion 124 from the constant curvature of the dome portion 11.

Angles θx and θy of valley bending portion 15 are less than 1°, it is desired to increase the height of the dome portion 11 in order to obtain a click feeling. In this case, although the region of the dome portion 11 is increased, the increasing of the region of the dome portion 11 is undesirably as a switch, since a downsizing is desirable for a switch. Further, it Is undesirable that each of the angles θx and θy of valley bending portion 15 is larger than 15°, since the dome portion 11 is hardly pressed.

The first crest bending portion 16 is disposed between the outer peripheral portion 12 and the first support portion 13, and bent convexly upward. The second crest bending portion 1 is disposed between the outer peripheral portion 12 and the second support portion 14, and bent convexly upward.

The width Wy in the first direction between the recesses of the valley bending portion 15 forming the outer edge of the dome portion 11 is preferably 60% or more and less than 80% of the distance WY between the outer edges of the first support portion 13 and the second support portion 14, in one aspect the width Wy is 66%. If the width Wy in the first direction is less than 60% of the distance WY between the outer edges of the first support portion 13 and the second support portion 14, the size of the dome portion 11 become small, and therefore click feeling is reduced. When the width Wy in the first direction is larger than 80% of the distance WY between the outer edges of the first support portion 13 and the second support portion 14, the distance between the outer edges of the first support portion 13 and the second support portion 14 in which cut surface is formed is shortened, and therefore risk of damage by repeating the pressing operation may be increased.

The width Wx between the recesses of the valley bending portion 15 forming the outer edge of the dome portion 11 is preferably 60% or more and less than 90% of the distance WX between the outer edges the second side end portion 122 and the first side end portion 121, and in one aspect the width Wx is 70%. When the width Wx is less than 60% of the distance WX between the outer edges of the second side end portion 122 and the first side end portion 121, the size of the dome portion 11 become small, and therefore click feeling is reduced. When the width Wx is greater than 90% of the distance WX between the outer edges of the second side end portion 122 and the first side end portion 121, the distance between the outer edges of the second side end portion 122 and the first side end portion 121 in which cut surface is formed is shortened, and therefore spring 1 may be damaged by repeating the pressing operations.

Figure 6A:
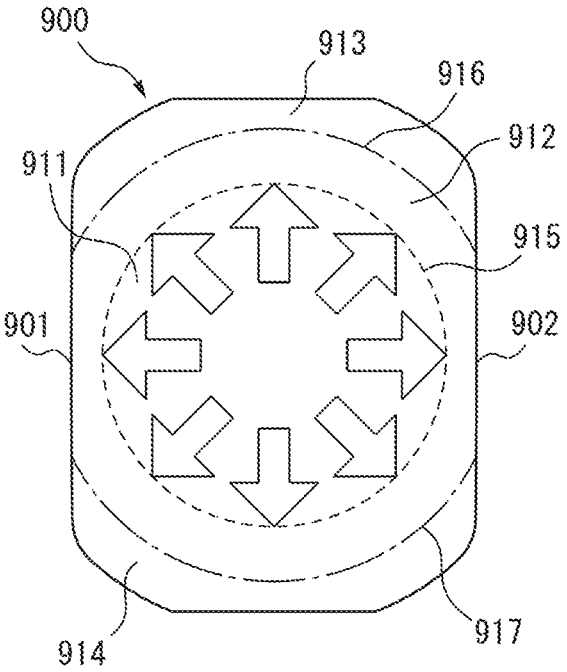
FIG. 6A is a figure showing the spread of the dome portion when the spring according to the comparative example is pressed.
Figure 6B:
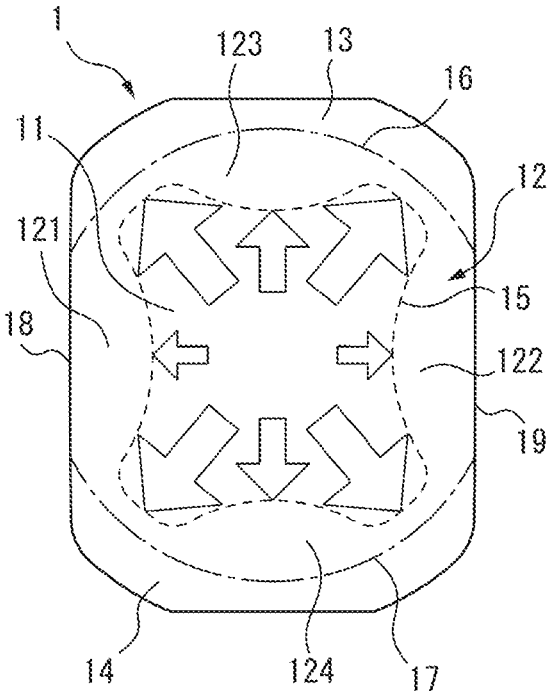
FIG. 6B is a diagram showing the spread of the dome portion when the spring shown in FIG. 3 is pressed.
Figure 6C:
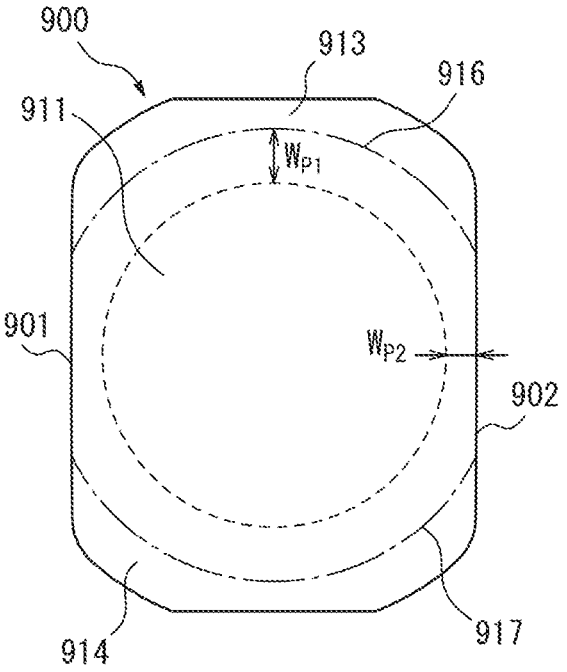
FIG. 6C is a diagram showing the spread of the dome portion when the spring according to the comparative example is pressed.
Figure 6D:
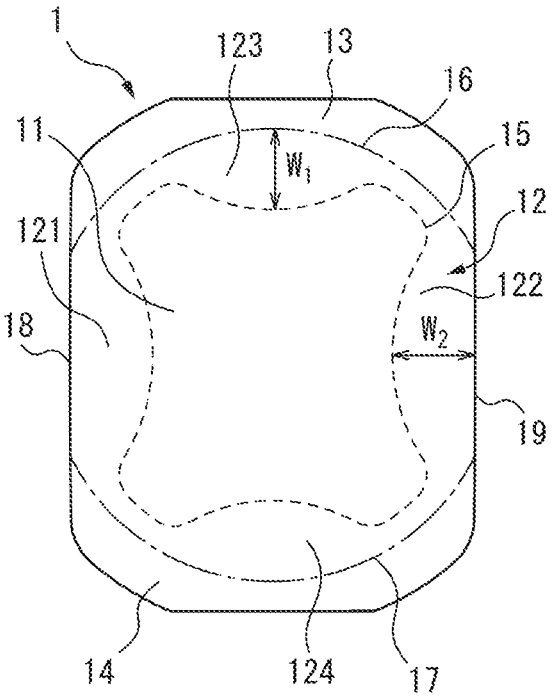
FIG. 6D is a diagram showing the spread of the dome portion when the spring 1 is pressed.

FIG. 6A is a diagram showing the spread of the dome portion when the spring according to the comparative example is pressed, and FIG. 6B is a diagram showing the spread of the dome portion 11 when the spring 1 is pressed. FIG. 6C is a diagram showing the spread of the dome portion when the spring according to the comparative example is pressed, and FIG. 6D is a diagram showing the spread of the dome portion 11 when the spring 1 is pressed.

The spring 900 according to the comparative example has a dome portion 911, an outer peripheral portion 912, a first support portion 913, and a second support portion 914. The spring 900 is different from the spring 1 in that the planar shape of the dome portion 911 is substantially circular. Since the elements and functions of the components of the spring 900 other than the planar shape of the dome portion 911 are similar to the elements and functions of the components having the same name of the same spring 1, a detailed description thereof will be omitted here.

Since in the spring 900, the dome portion 911 has a circular planar shape, when the dome portion 911 is pressed, the dome portion 911 spreads evenly over the entire circumference. Further, in the width of the outer peripheral portion 916 of the spring 900, $W_{P2}$ between the dome portion 911 and the longitudinal direction of the outer peripheral portion 901 and 902 is shorter than the length $W_{P1}$ between the dome portion 911 and the first and second support portion 913 and 914.

Therefore, when the spring 900 is pressed, the magnitude of the stress applied by pressing gradually increases toward the outer peripheral edge from the top. In the spring 900, since the stress applied by pressing becomes maximum at the outer peripheral portions 901 and 902 in the longitudinal direction in which the fractured surface is formed during punching, cracks may be formed in the outer peripheral portions 901 and 902 by repeating the pressing operations.

On the other hand, in the spring 1, since the dome portion 11 has a planar shape in which each of the four corners is convex, when the dome portion 11 is pressed, four corners extend greater than the side curved inwardly. Further, in the spring 1, the long sides extending in the first direction are spread smaller than the short side extending in the second direction. Both the length $W_1$ in the longitudinal direction and the length $W_2$ in the lateral direction of the outer peripheral portion 12 of the spring 1 are longer than the length $W_{P1}$ in the longitudinal direction and the length $W_{P2}$. In the lateral direction of the outer peripheral portion 12 of the spring 900 according to the comparative example.

In the spring 1, when the dome portion 11 is pressed, the stress applied to the sides of the dome portion 11 may be reduced, since four corners extend greatly. Further, in the spring 1, since the spread of the long side extending in the first direction is smaller than that of the short side, the stress applied in the longitudinal direction of the spring 1 may be further reduced. Further, since the length $W_1$ in the longitudinal direction and the length $W_2$ in the lateral direction of the outer peripheral portion 12 of the spring 1 are longer than the length $W_{P1}$ in the longitudinal direction and the length $W_{P2}$ in the lateral direction of the outer peripheral portion 12 of the spring 900, stresses applied to the outer peripheral edge portions 18 and 19 in the lateral direction of the outer peripheral portion in which the fracture surface is formed may be further reduced.

Further, in the spring 1, since the dome portion 11 has a planar shape in which four corners extend convexly, and the size of dome portion 911 having a substantially circular planar shape is defined by the length in the longitudinal direction, the size of the dome portion 11 is larger than that of the dome portion 911. Since the size of the dome portion 11 is larger than that of the dome portion 911 according to the comparative example, the spring 1 may realize a good click feeling in the same size.

Further, since the dome portion 11 has a planar shape in which four corners extend in a convex shape, when the spring 1 are superimposed, the longitudinal direction and lateral directions may be arranged so as to coincide, in other words, the spring 1 has a so-called self-alignment effect. Since the spring 1 has a self-alignment effect, even if the springs 1 are superimposed in a switch, the longitudinal and lateral directions of the superimposed springs are not shifted, and therefore the load caused by eccentricity of the springs 1 affects the life time of the springs 1 lowly.

<Method of Manufacturing a Spring According to the First Embodiment>

Figure 7A:
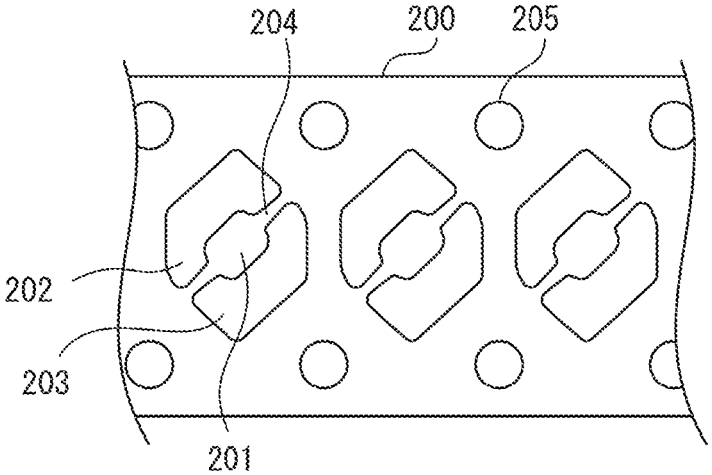
FIG. 7A is a diagram showing a first step of the manufacturing process of the spring shown in FIG. 3.
Figure 7B:
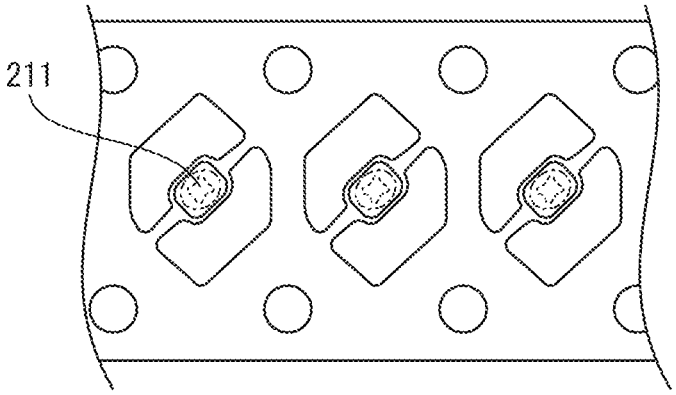
FIG. 7B is a diagram showing a second step of the manufacturing process of the spring shown in FIG. 3.
Figure 7C:
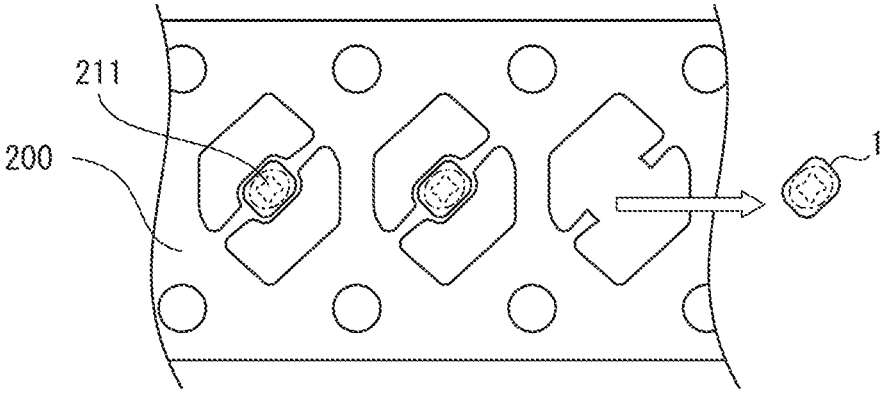
FIG. 7C is a diagram showing a third step of the manufacturing process of the spring shown in FIG. 3.

FIG. 7A is a diagram showing a first step of the manufacturing process of the spring 1, FIG. 7B is a diagram showing a second step of the manufacturing process of the spring 1, and FIG. 7C is a diagram showing a third step of the manufacturing process of the spring 1.

First, in the first step, the outer shape portion 201 corresponding to the outer shape of the spring 1 is formed by punching a coil material 200 which is stainless steel having a thickness of 25 μm to 60 μm. Pilot holes 205 used for positioning are disposed side by side in the longitudinal direction of the coil material 200. In the longitudinal direction of the outer shape portion 201, vent holes 202 and 203 are formed. Both longitudinal direction ends of the outer shape portion 201 are connected with the coil member 200 via a connecting portion 204. In one aspect, the coil member 200 is punched so that the longitudinal extending direction is inclined, for example, 45° with respect to the rolling direction of the coil member 200. The punched angle at which the outer shape portion 201 with respect to the rolling direction of the coil material 200 may be an angle other than 45° such as 0° or 90°.

Next, in the second step, press-shaped portions 211 having a shape corresponding to each of the dome portion 11, the outer peripheral portion 12, the first support portion 13 and the second support portion 14 are formed by pressing the outer shape portion 201. In the press-shaped portion 211, concave shapes are bent among the shapes corresponding to the dome portion 11 and the outer peripheral portion 12 in when viewed from the surface side of the coil member 200. Further, convex shapes are bent among the shape corresponding to the outer peripheral portion 12 and the shape corresponding to the first support portion 13 and the second support portion 14 when viewed from the surface side of the coil member 200.

Then, in the third step, each of springs 1 are formed by cutting the press-shaped portion 211 from the coil material 200.

<Configuration and Function of the Switch Equipped with the Spring According to the Second Embodiment>

Figure 8A:
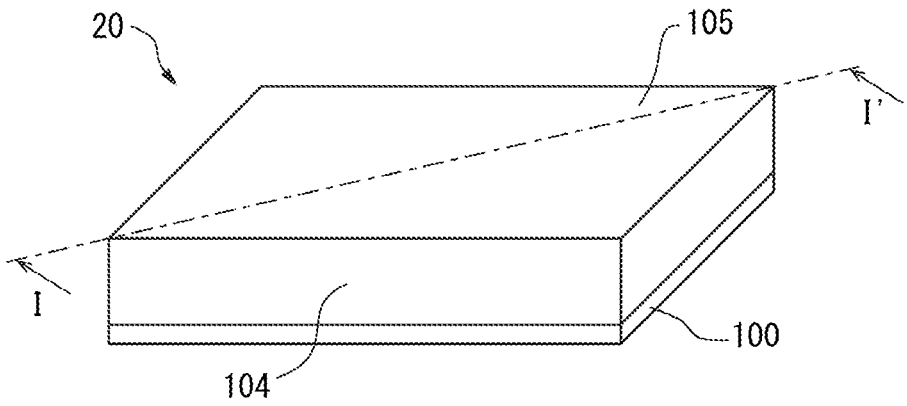
FIG. 8A is a perspective view of a switch mounted with a spring according to the second embodiment.
Figure 8B:
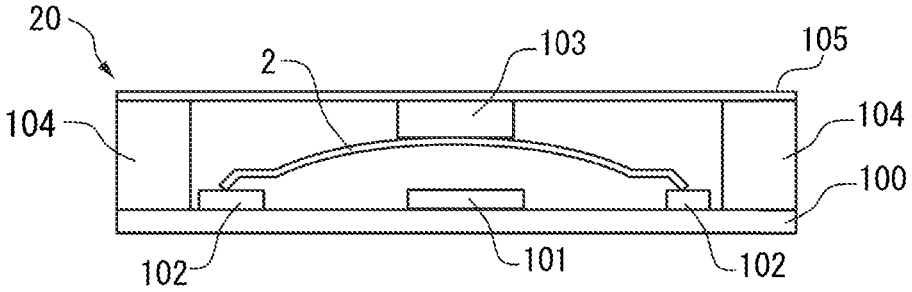
FIG. 8B is a sectional view along I-I' shown in FIG. 8A.
Figure 8C:
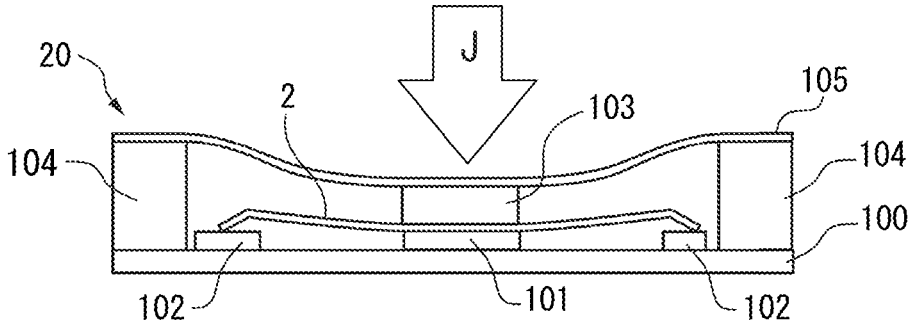
Figure 9:
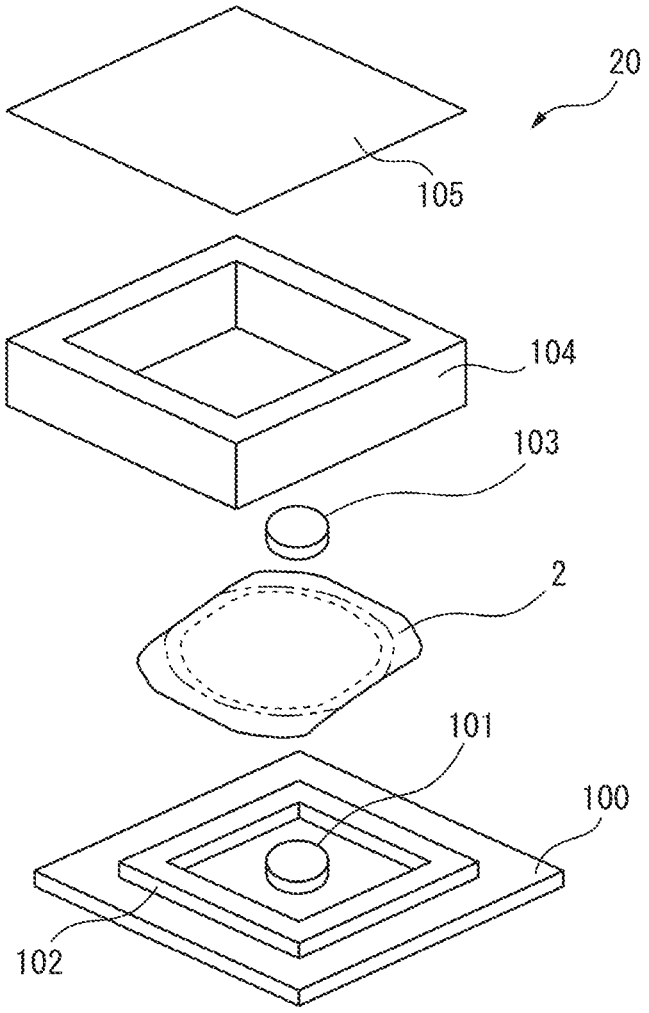
FIG. 9 is an exploded perspective view of a switch shown in FIG. 8A.

FIG. 8A is a perspective view of a switch mounted with a spring according to the second embodiment, FIG. 8B is a sectional view along I-I' shown in FIG. 7A, and FIG. 8C is a cross-sectional view of a state in which the switch shown in FIG. 8A is pressed in the direction. FIG. 9 is an exploded perspective view of the switch shown in FIG. 8A.

The switch 20 is different from the switch 10 in that the switch 20 has a spring 2 instead of the spring 1. Since the elements and functions of the components of the switches 20 other than the spring 2 are similar to the elements and functions of the components having the same reference numerals of spring 1, a detailed description thereof will be omitted.

<Configuration and Function of the Spring According to the Second Embodiment>

Figure 10A:
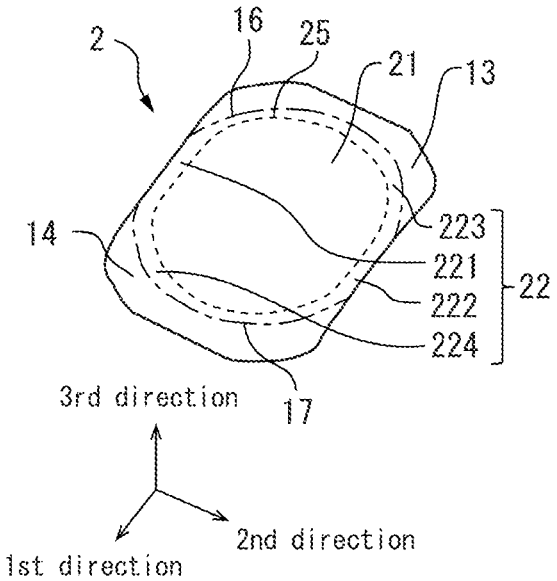
FIG. 10A is a perspective view of a spring shown in FIG. 9.
Figure 10B:
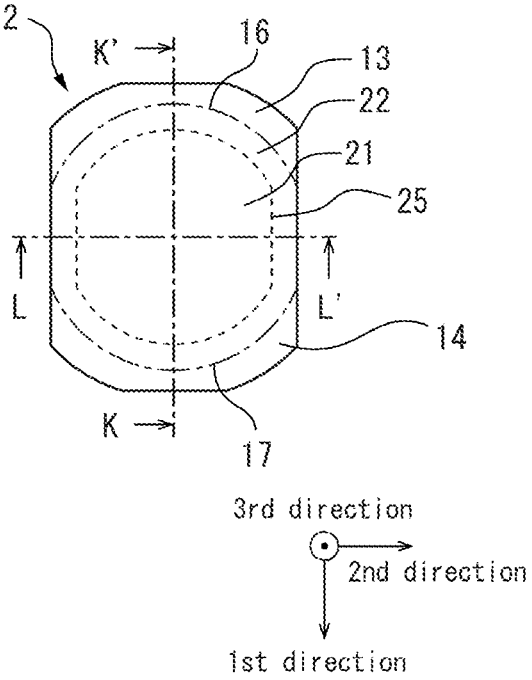
FIG. 10B is a plan view of the spring shown in FIG. 9.

FIG. 10A is a perspective view of a spring 1, and FIG. 10B is a plan view of the spring 1.

The spring 2 is different from the spring 1 in that the spring 2 has a dome portion 21 and the outer peripheral portion 22 instead of the dome portion 11 and the outer peripheral portion 12. Since the elements and functions of the spring 2 other than the dome portion 21 and the outer peripheral portion 22 are similar to the elements and functions of components having the same reference numerals of the spring 1, a detailed explanation thereof will be omitted.

The dome portion 21 has a planar shape of the dome shape extending in each of the first direction i.e., a longitudinal direction and the second direction I.e., a lateral direction perpendicular to the first direction so that the first direction is longer than the second direction, and has a shape that bulges convexly toward the third direction i.e. upward.

The outer peripheral portion 22 is disposed along the entire periphery of the dome portion 21 via the valley bending portion 25. The outer peripheral portion 22 has a first side end 221, a second side end 222, a first shoulder 223, and a second shoulder 224, and formed so as to extend in the horizontal direction.

The first side end 221 and the second side end 222 are disposed to extend in a first direction along the longitudinal direction of the dome portion 21 so as to include a side end of the spring. Since each of the first side end portion 221 and the second side end portion 222 is disposed to include a side end of the spring, the first side end portion 221 and the second side end portion 222 are both ends in second direction, i.e., the lateral direction of the spring 1. Further, each of the outer edges of the first side end portion 221 and the second side end portion 222 extends linearly in the first direction. Furthermore, each of valley bending portions 25 formed between the first and second side end portion 221 and 222 and the dome portion 11 extends linearly in the first direction.

The first shoulder 223 and the second shoulder 224 have a planar shape on an arc and disposed on each of both ends of the dome portion 11 in the first direction via the valley bends 25 which is curved outwardly and extend in the second direction. Since the first shoulder 223 is disposed between the first side end 221 and the first support portion 13, the first side end 121 is not directly connected to the first support portion 13. Since the second shoulder 224 is disposed between the second side end 222 and the second support portion 14, the second side end 222 is not directly connected to the second support portion 14. The first shoulder 223, the second shoulder 224, the second side end 222, and the first shoulder 223 may be flat.

The valley bending portion 25 is disposed between the dome portion 21 and the outer peripheral portion 22, and bent concavely upward.

Figure 11B:
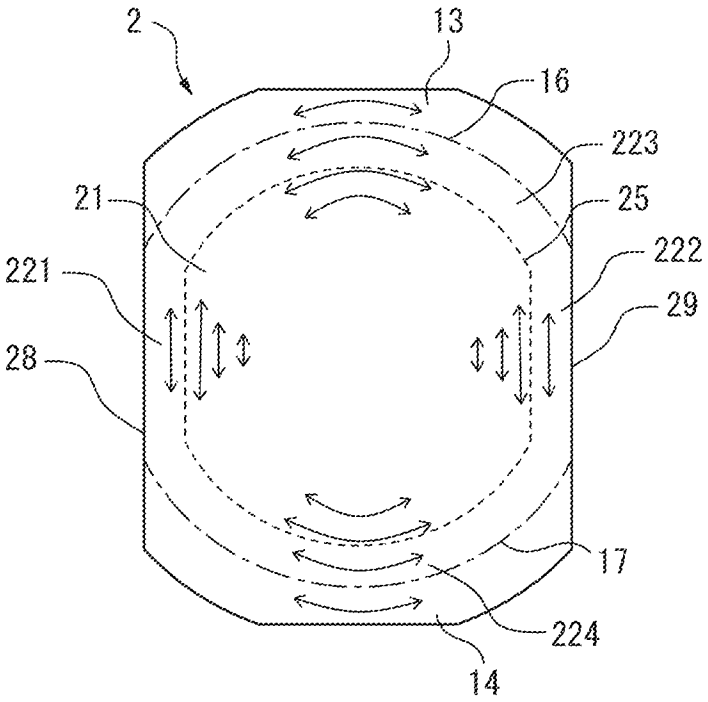
FIG. 11B is a diagram showing a stress distribution when the spring shown in FIG. 8 is pressed.
Figure 11A:
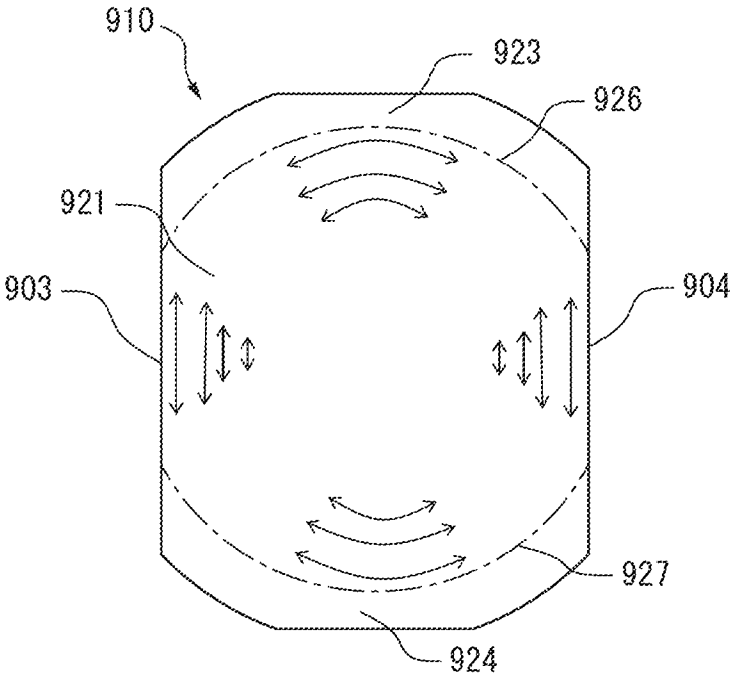
FIG. 11A is a diagram showing a stress distribution when the spring according to the comparative example is pressed.

FIG. 11A is a diagram showing a stress distribution when the spring according to the comparative example is pressed, and FIG. 11B is a diagram showing a stress distribution when the spring 2 is pressed.

Spring 910 according to the comparative example has a dome portion 921, a first support portion 923, and a second support portion 924. Each of the dome portion 921, the first support portion 923 and the second support portion 924 has a configuration corresponding to the dome portion 11, the first support portion 13 and the second support portion 14 of the spring 2. The dome portion 921 has a dome shape extending in each of the first direction i.e., a longitudinal direction and the second direction i.e., a lateral direction perpendicular to the first direction, so that the first direction is longer than the second direction, and has a shape that bulges convexly upward. The first support portion 923 and the second support portion 924 are disposed at both ends in the first direction of the dome portion 921 via each of the first crest bent portion 926 and the second crest bent portion 927 which are bent convexly upward.

When the spring 910 is pressed, the magnitude of the stress applied by pressing gradually increases toward the outer peripheral edge from the top. In the spring 910, since the stress applied by pressing becomes maximum at the outer peripheral portion 903 and 904 in the longitudinal direction in which the fractured surface is formed during punching, cracks may be formed in the outer peripheral portion 903 and 904 by repeating the pressing operations.

On the other hand, in the spring 2, the first side end portion 221 and the second side end portion 222 are disposed via the valley bending portions 25 between the outer peripheral portions 28 and 29 and the dome portion 21 in the longitudinal direction in which fractured surface is formed during punching. Since a valley bending portions 25 between the first and second side end portion 221 and 222 and the dome portion 21 are formed, when the spring 2 is pressed, the stress applied to the first and second side end portion 221 and 222 becomes smaller than the stress applied to the outer peripheral end of the dome portion 21. In the spring 1, since when the spring 1 is pressed, the stress applied to the first and second side end portion 221 and 222 is reduced, the stress applied to the outer peripheral portion 28 and 29 in the longitudinal direction in which fractured surface is formed may be reduced.

<Method of Manufacturing a Spring According to the Second Embodiment>

Figure 12A:
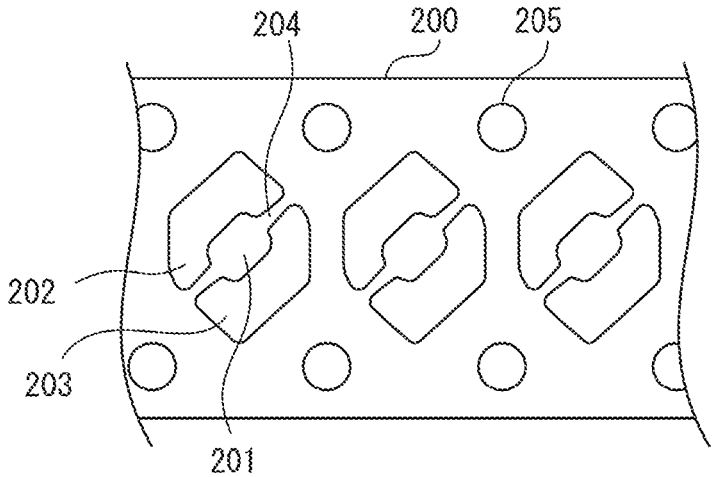
FIG. 12A is a diagram showing a first step of the manufacturing process of the spring shown in FIG. 9.
Figure 12B:
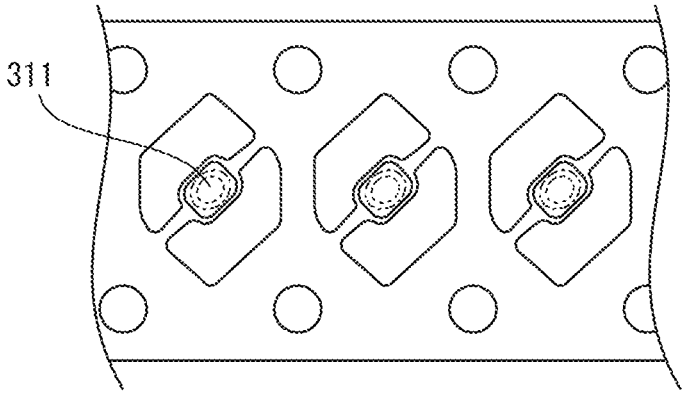
FIG. 12B is a diagram showing a second step of the manufacturing process of the spring shown in FIG. 9.
Figure 12C:
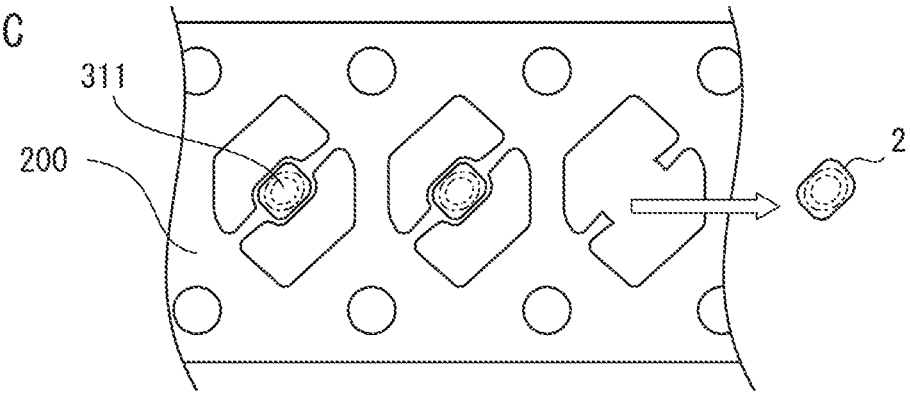
FIG. 12C is a diagram showing a third step of the manufacturing process of the spring shown in FIG. 9.

FIG. 12A is a diagram showing a first step of the manufacturing process of the spring 2, FIG. 12B is a diagram showing a second step of the manufacturing process of the spring 2, and FIG. 12C is a diagram showing a third step of the manufacturing process of the spring 2.

Since manufacturing process of the spring 2 shown in FIGS. 12A to 12C is similar to the manufacturing process of the spring 1 shown in FIG. 7, except that the shape of the mold used in the press working in the second step of forming the shape 311 corresponding to the dome portion 21 and the outer peripheral portion 22, a detailed description thereof will be omitted.

<Modification of the Spring According to the Embodiment>

Figure 13A:
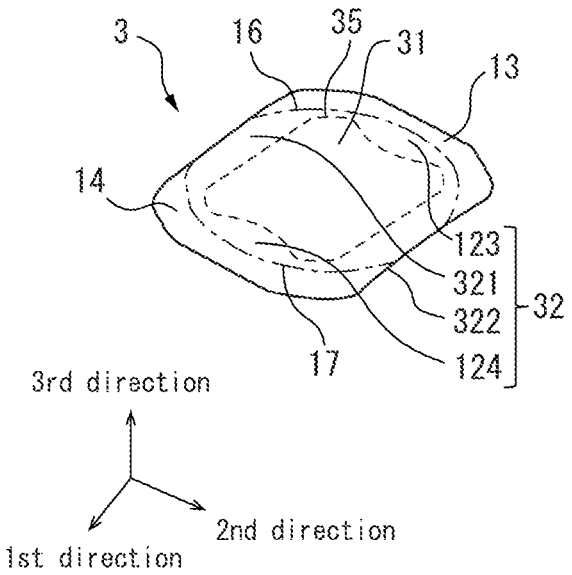
FIG. 13A is a perspective view of a spring according to a first modification.
Figure 13B:
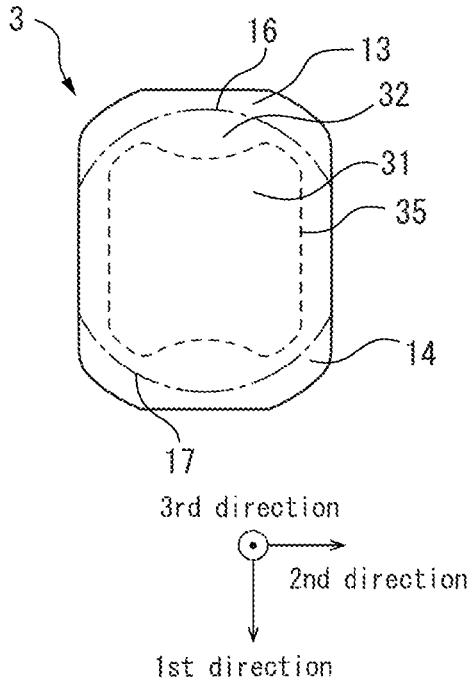
FIG. 13B is a plan view of the spring according to the first modification.

FIG. 13A is a perspective view of a spring according to a first modification, FIG. 13B is a plan view of the spring according to the first modification.

A spring 3 according to the first modification is different from the spring 1 in that the spring 3 has the dome portion 31 and the outer peripheral portion 32 instead of the dome portion 11 and the outer peripheral portion 12. Since the elements and functions of the components of the spring 3 other than the dome portion 31 and the outer peripheral portion 32 are similar to the elements and functions of the components having the same reference numerals of the spring 1, a detailed description thereof will be omitted here.

The dome portion 31 is different from the dome portion 11 in that the valley bending portion 35 is bent concavely upward, and forming the outer edge of the dome portion 31 to extend linearly in the first direction.

The outer peripheral portion 32 is different from the outer peripheral portion 12 in that the outer peripheral portion 32 has the first side end portion 321 and the second side end portion 322 instead of the first side end portion 121 and the second side end portion 122. Since the elements and functions of the components of the outer peripheral portion 32 other than the first side end portion 321 and the second side end portion 322 are similar to the elements and functions of components having the same reference numerals of the outer peripheral portion 12, a detailed description thereof will be omitted.

Since the valley bending portion 35 extends linearly in the first direction, each of the first side end portion 321 and the second side end portion 322 is different from the first end portion 121 and the second side end portions 122 in that the inner edge extends linearly without curved inwardly. In the manufacturing process of the spring 3, the dome portion 31, the first side end portion 321 and the second side end portion 322 are formed by pressing so that the valley bending portion 35 forming the outer edge of the dome portion 31 extends linearly in the first direction.

Figure 14A:
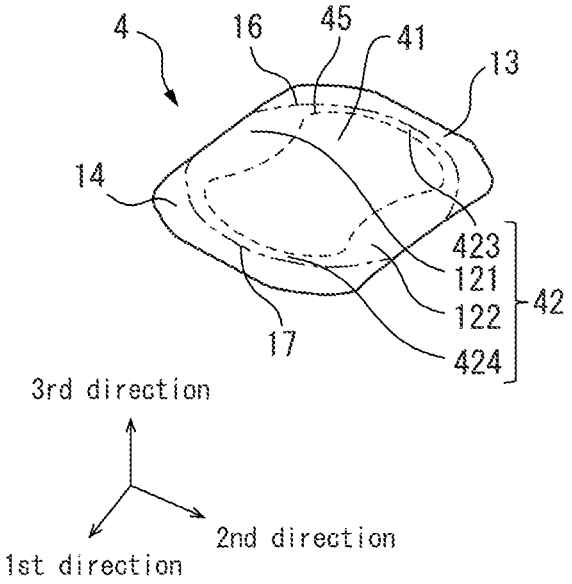
FIG. 14A is a perspective view of a spring according to a second modification.
Figure 14B:
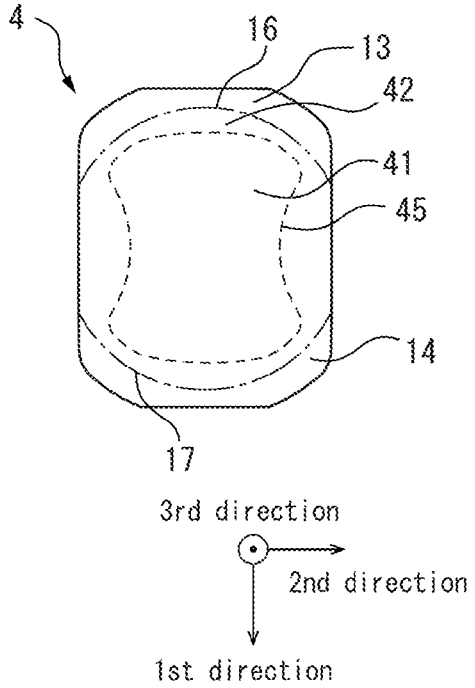
FIG. 14B is a plan view of the spring according to the second modification.

FIG. 14A is a perspective view of a spring according to a second modification, and FIG. 14B is a plan view of a spring according to a second modification.

A spring 4 according to the second modification is different from the spring 1 in that the spring 4 has a dome portion 41 and the outer peripheral portion 42 instead of the dome portion 11 and the outer peripheral portion 12. Since the elements and functions of the components of the spring 4 other than the dome portion 41 and outer peripheral portion 42 are similar to the elements and functions of the components having the same reference numerals of the spring 1, a detailed description thereof will be omitted here.

The dome portion 41 is different from the dome portion 11 in that the dome portion 41 is bent concavely upward, and a valley bending portion 45 forming the outer edge of the dome portion 41 extends curved outwardly in the second direction.

The outer peripheral portion 42 is different from the outer peripheral portion 12 in that the outer peripheral portion 42 has the first shoulder portion 423 and the second shoulder portion 424 instead of the first shoulder portion 123 and the second shoulder portion 124. Since the elements and functions of the components of the outer peripheral portion 42 other than the first shoulder portion 423 and the second shoulder portion 424 are similar to the elements and functions of the components of the outer peripheral portion 12 having the same reference numerals, a detailed description thereof will be omitted here.

Since the valley bend 45 extends outwardly in a second direction, each of the first shoulder 423 and the second shoulder 424 is different from the first shoulder 123 and the second shoulder 124 in that the inner edge is curved outwardly rather than inwardly. In the manufacturing process of the spring 4, the dome portion 41, the first shoulder portion 423 and the second shoulder portion 424 are formed by pressing so that a valley bending portion 45 forming the outer edge of the dome portion 41 extends curved outward in the second direction.

Figure 15A:
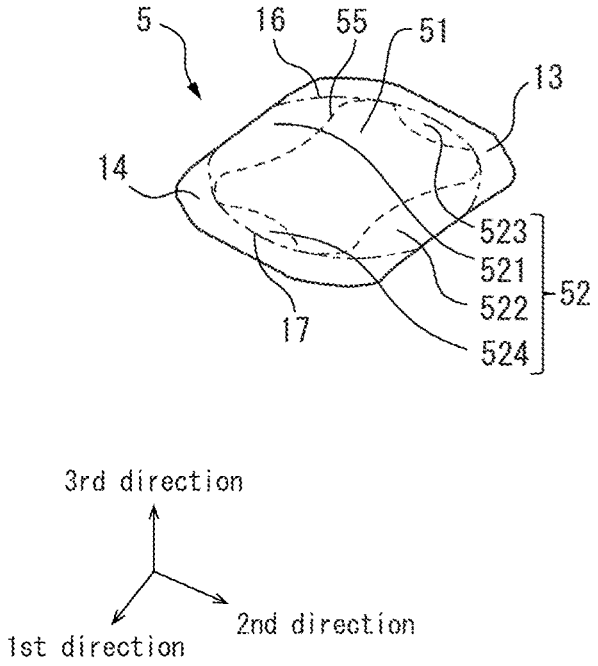
FIG. 15A is a perspective view of a spring according to a third modification.
Figure 15B:
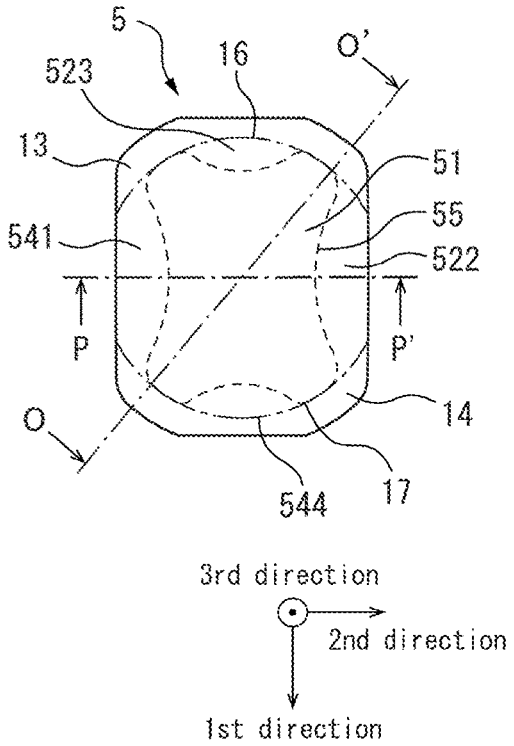
FIG. 15B is a plan view of a spring according to a third modification.
Figure 15C:
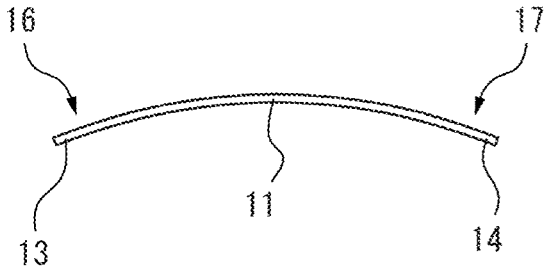
FIG. 15C is a sectional view along the line O-O' shown in FIG. 15B.
Figure 15D:
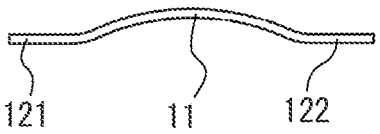
FIG. 15D is a sectional view along the line P-P' shown in FIG. 15B.

FIG. 15A is a perspective view of a spring according to a third modification, FIG. 15B is a plan view of a spring according to a third modification, FIG. 15C is a cross-sectional view along the line O-O' shown in FIG. 15B, and FIG. 15D is a sectional view along the line P-P' shown in FIG. 15B.

A spring 5 according to a third modification is different from the spring 1 in that the spring 5 has a dome portion 51 and the outer peripheral portion 52 instead of the dome portion 11 and the outer peripheral portion 12. Since the elements and functions of the components of the spring 5 other than the dome portion 51 and the outer peripheral portion 52 are similar to the elements and functions of the components having the same reference numerals of the spring 1, a detailed description thereof will be omitted here.

The dome portion 51 is different from the dome portion 11 in that the dome portion 51 is bent concavely upward, a valley bending portion 55 forming the outer edge of the dome portion 51 is formed so as not to include four corners.

The outer peripheral portion 52 has a first side end 521, a second side end 522, a first shoulder 523 and a second shoulder 524. Each of the first side end 521, the second side end 522, the first shoulder 523 and the second shoulder 524 is separated at four corners of the dome portion 51.

Since the first side end 521, the second side end 522, the first shoulder 523, and the second shoulder 524 are separated at four corners of the dome portion 51, the pair of lateral extensions extending in the lateral direction of the spring included in the valley bend 55 and the pair of longitudinal extensions extending in the longitudinal direction of the spring do not touch each other. Thus, as shown in the cross-sectional view along the O-O' line, a valley bending portion 55 is not formed between the dome portion 51 and the first and second support portion 13 and 14, and only the first crest bending portion 16 and the second crest bending portion 17 are formed therebetween.

Further, the valley bending portion 55 formed between the first and second side end 521 and 522 and the first and second shoulder 523 and 524, and the dome portion 51 is formed so that the first side end 521, the second side end 522, the first shoulder 523 and the second shoulder 524 are curved inward. In the manufacturing process of the spring 5, the dome portion 51, the outer peripheral portion 52, the first side end 521, the second side end 522, the first shoulder 523 and the second shoulder 524 are formed by pressing so that the valley bending portion 55 forming the outer edge of the dome portion 41 extends curved inward the valley bending.

Figure 16A:
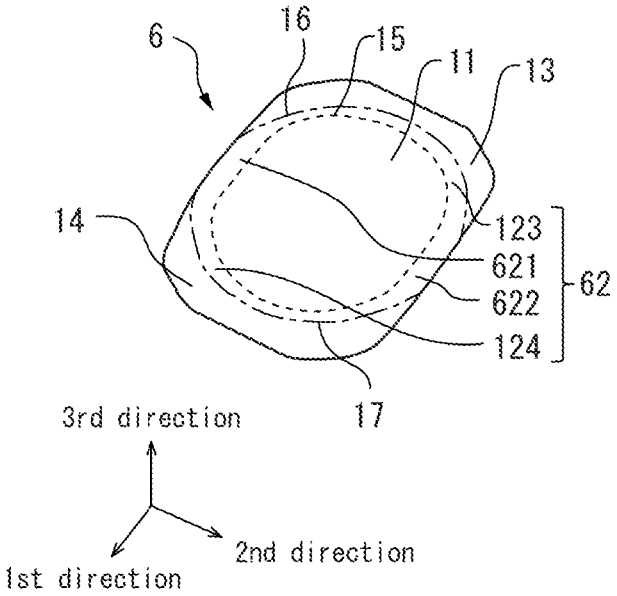
FIG. 16A is a perspective view of a spring according to a fourth modification.
Figure 16B:
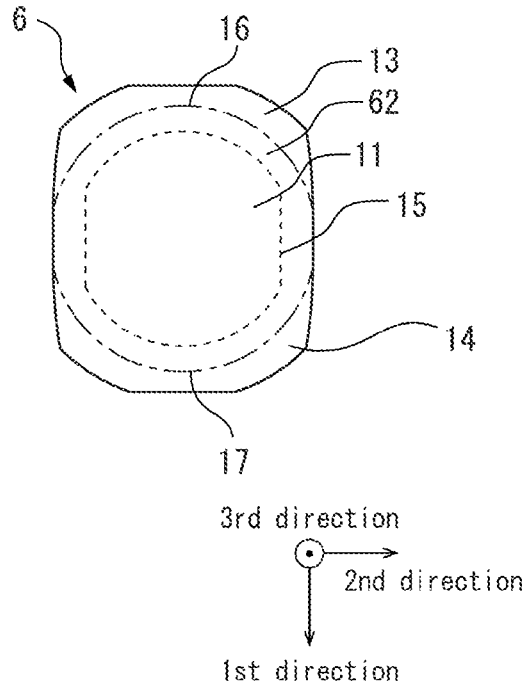
FIG. 16B is a plan view of a spring according to a fourth modification.
Figure 16C:
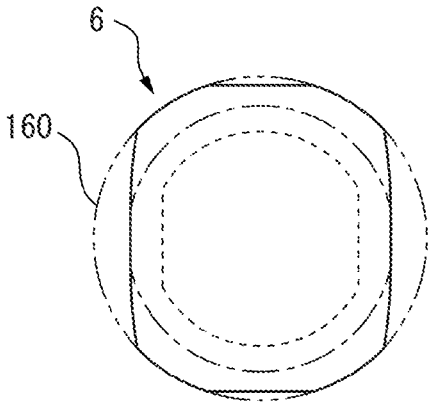
FIG. 16C is a figure for explaining the spring according to a fourth modification (part 1)
Figure 16D:
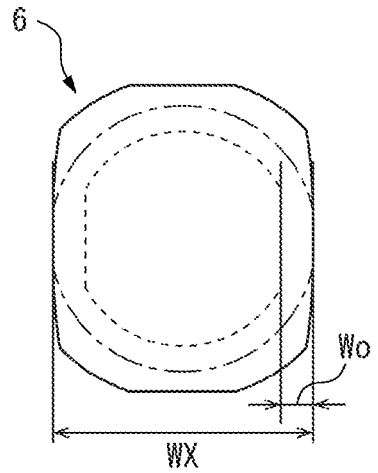
FIG. 16D is a figure for explaining the spring according to a fourth modification (part 2)

FIG. 16A is a perspective view of a spring according to a fourth modification, and FIG. 16B is a plan view of a spring according to a fourth modification. FIG. 16C is a diagram for explaining a spring according to a fourth modification (part 1), and FIG. 16D is a diagram for explaining a spring according to a fourth modification (part 2).

A spring 6 according to a fourth modification is different from the spring 2 in that the spring 4 has an outer peripheral portion 62 instead of the outer peripheral portion 22. Since the elements and functions of the components of the spring 6 other than the outer peripheral portion 62 are similar to the elements and functions of the components having the same reference numerals of the spring 2, a detailed description thereof will be omitted here.

The outer peripheral portion 62 is different from the outer peripheral portion 22 in that the outer peripheral portion 62 has the first side end portion 621 and the second side end portion 622 instead of the first side end portion 221 and the second side end portion 222. Since the elements and functions of the components of the outer peripheral portion 62 other than the first side end portion 621 and the second side end portion 622 are similar to the elements and functions of the components having same reference numerals of the outer peripheral portion 22, a detailed description thereof will be omitted.

Each of the first side end portion 621 and the second side end portion 622 is different from the first side end portion 221 and the second side end portion 222 in that the outer edge is curved in an arc shape toward the outside rather than straight. In the manufacturing process of the spring 2, when the outer shape portion having an outer shape corresponding to the outer shape of the spring 6 by punching the coil material is formed, the first side end portion 621 and the second side end portion 622 are formed by punching so that the longitudinal direction of the outer shape portion is curved in an arc shape.

The curvatures of the outer edges of the first side end portion 621 and the second side end portion 622 are larger than the curvature of the virtual circle 160 in contact with at least 3 points of the outer edge of the spring 6. Since the curvatures of the outer edges of the first side end portion 621 and the second side end portion 622 are larger than the curvature of the virtual circle 160 in contact with at least 3 points of the outer edge of the spring 6, the outer edges of the first side end portion 621 and the second side end portion 622 are located inside the virtual circle 160.

Further, the distance Wo between the top of the outer edges of the first side end portion 621 and the second side end portion 622 and the valley bending portion 15 forming the outer edge of the dome portion 11 may be curved outwardly in a range of 0% or more and 30% or less of the length WX in the longitudinal direction of the spring 6.

Figure 17A:
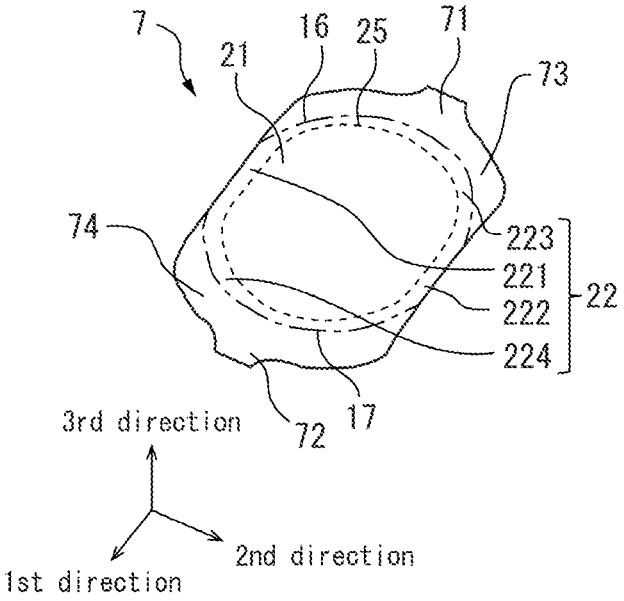
FIG. 17A is a perspective view of a spring according to a fifth modification.
Figure 17B:
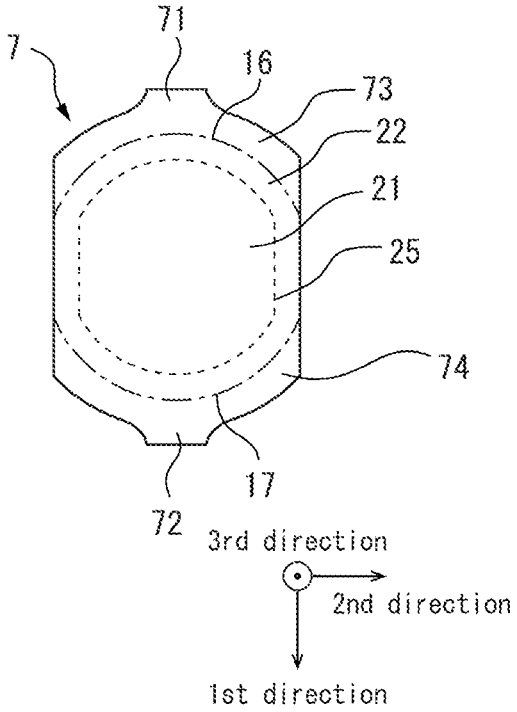
FIG. 17B is a plan view of a spring according to a fifth modification.

FIG. 17A is a perspective view of a spring according to a fifth modification, and FIG. 17B is a plan view of a spring according to a fifth modification.

A spring 7 according to the fifth modification is different from the spring 2 in that the spring 7 has the first support portion 73 and the second support portion 74 instead of the first support portion 13 and the second support portion 14. Since the elements and functions of the components of the spring 7 other than the first support portion 73 and the second support portion 74 are similar to the elements and functions of the components having same reference numerals of the spring 2, a detailed description thereof will be omitted.

Each of the first support portion 73 and the second support portion 74 is different from the first support portion 13 and the second support portion 14 in that the first support portion 73 has a first protrusion 71, and the second support portion 74 has the second protrusion 72. The first protrusion 71 is disposed on the outer edge of the first direction of the first support portion 73, and the second protrusion 72 is disposed on the outer edge of the first direction of the second support portion 74. Each of the first direction end of the first protruded portion 71 and the second protruded portion 72 extends linearly in the second direction.

In the manufacturing process of the spring 7, when the springs 7 are separated by cutting the press-shaped portion from the coil material, each of the first protrusion 71 and the second protrusion 72 is formed so as to include a portion of the connecting portion for connecting the coil material with the press-shaped portion.

Figure 18A:
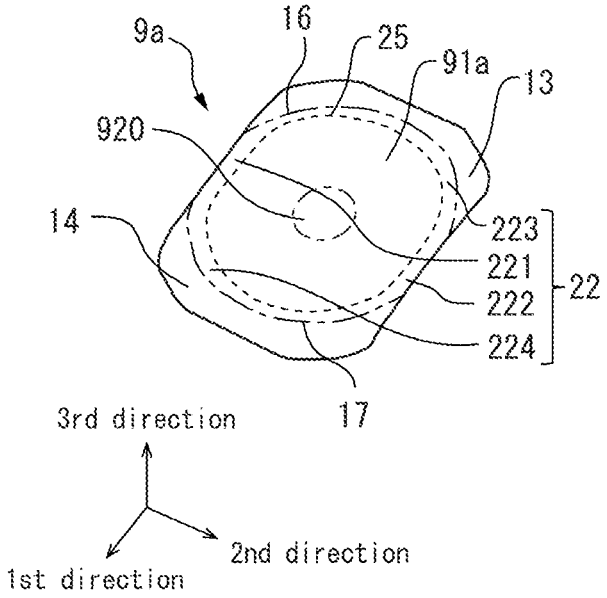
FIG. 18A is a perspective view of a spring according to a sixth modification.
Figure 18B:
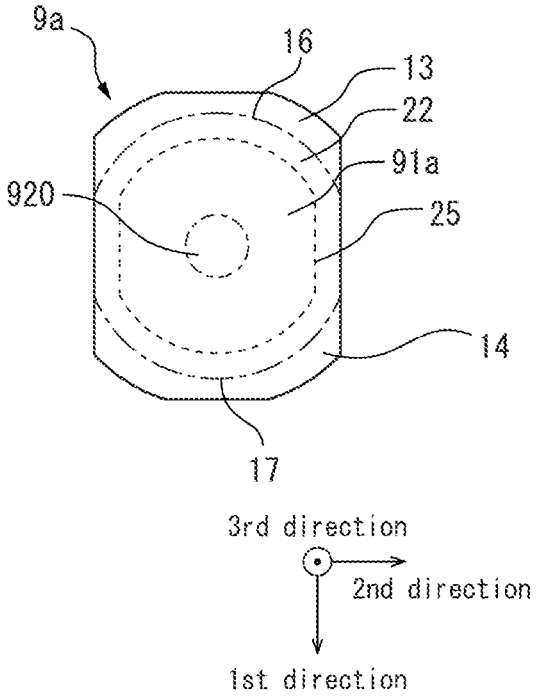
FIG. 18B is a plan view of a spring according to a sixth modification.

FIG. 18A is a perspective view of a spring according to a sixth modification, and FIG. 18B is a plan view of a spring according to a sixth modification.

A spring 9*a* according to a sixth modification is different from the spring 2 in that the spring 9*a* has a dome portion 91*a* instead of the dome portion 21. Since the elements and functions of the components of the spring 9*a* other than the dome portion 91*a* are similar to the elements and functions of the components having the same reference numerals of the spring 2, a detailed description thereof will be omitted here.

The dome portion 91*a* is different from the dome portion 21 in that the recess 920 is formed on the top of the dome portion 91*a*. In the manufacturing process of the spring 9*a*, the dome portion 91*a* is formed by pressing so as to form a recess at the central portion of the dome portion 91*a*, when a pressing is performed to form the dome portion 91*a*, the first side end portion 221 and the second side end portion 222. Although a recess 920 is formed on the top of the dome portion 91, in the spring according to the embodiment, a plurality of recesses may be formed on a portion other than the top of the dome portion. Further, a flat portion may be formed on the dome portion instead of the recess 920. A flat portion extending in the horizontal direction may be formed on the top of the dome portion, and a plurality of flat portions extending inclined may be formed in a portion other than the top of the dome portion.

Figure 19A:
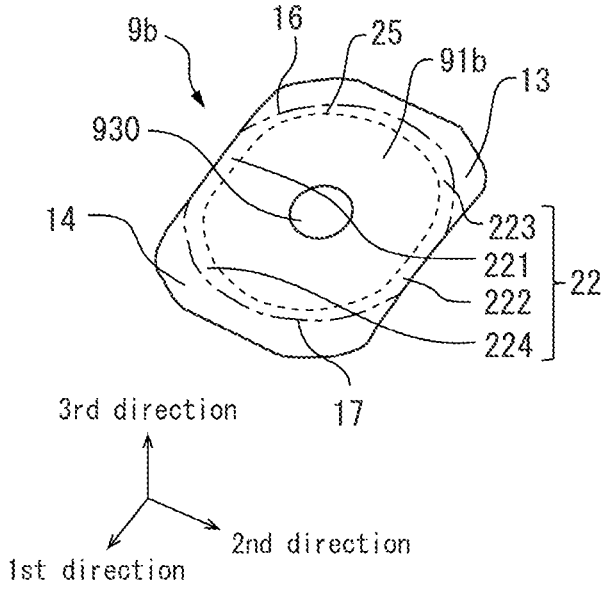
FIG. 19A is a perspective view of a spring according to a seventh modification.
Figure 19B:
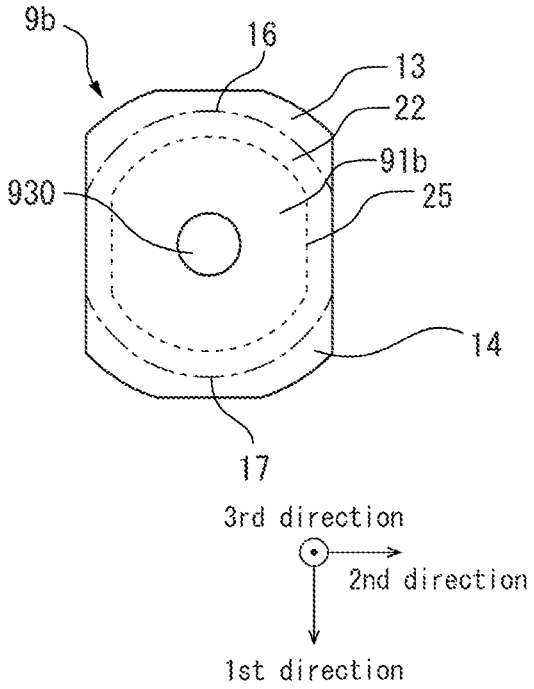
FIG. 19B is a plan view of a spring according to a seventh modification.

FIG. 19A is a perspective view of a spring according to a seventh modification, and FIG. 19B is a plan view of a spring according to a seventh modification.

A spring 9*b* according to a seventh modification is different from the spring 2 in that the spring 9*j* has a dome portion 91*b* instead of the dome portion 21. Since the elements and functions of the components of the spring 6 other than the dome portion 91*b* are similar to the elements and functions of the components having the same reference numerals of the spring 2, a detailed description thereof will be omitted here.

The dome portion 91*b* is different from the dome portion 21 in that the through hole 930 is formed on the top. In the manufacturing process of the spring 9*b*, the through hole 930 is formed by punching the center of the outer shape portion, when the outer shape portion formed by punching. Although the through hole 930 is formed on the top of the dome portion 91*b*, in the spring according to the embodiment, a plurality of through holes may be formed on a portion other than the top of the dome portion.

Figure 20A:
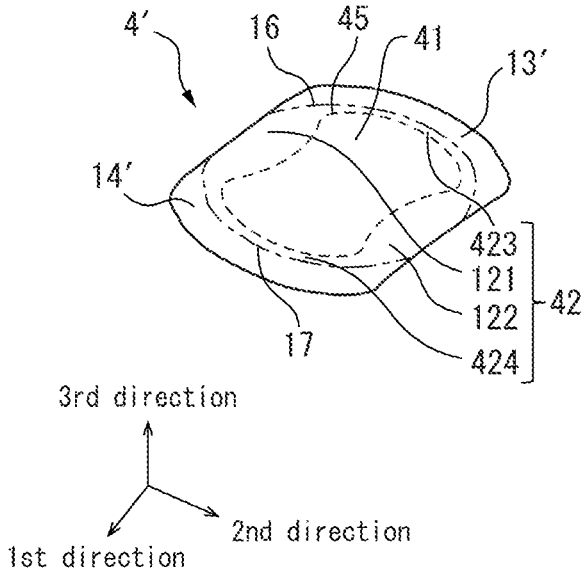
FIG. 20A is a perspective view of a spring according to a eighth modification.
Figure 20B:
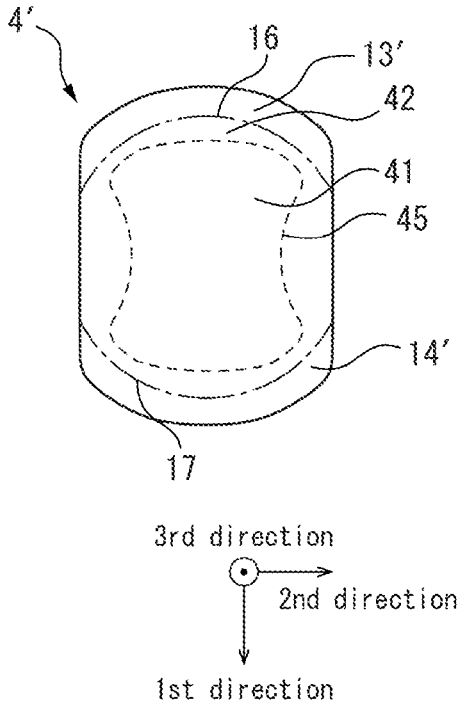
FIG. 20B is a plan view of the spring according to the eighth modification.

FIG. 20A is a perspective view of a spring according to an eighth modification, and FIG. 20B is a plan view of a spring according to an eighth modification.

A spring 4' according to the eighth modification is different from the spring 4 in that the spring 4' has the first support portion 13' and the second support portion 14' instead of the first support portion 13 and the second support portion 14. Since the elements and functions of the components of the spring 4' other than the first support portion 13' and the second support portion 14' are similar to the elements and functions of the components having the same reference numerals of the spring 4, a detailed description thereof will be omitted here.

Each of the first support portion 13' and the second support portion 14' is different from the first support portion 13 and the second support portion 14 in that the outer edge extends curved outward. In the manufacturing process of the spring 4', each of the first support portion 13' and the second support portion 14' are formed by pressing so that the outer edge of the first support portion 13' and the second support portion 14' extend curved outward.

Figure 21A:
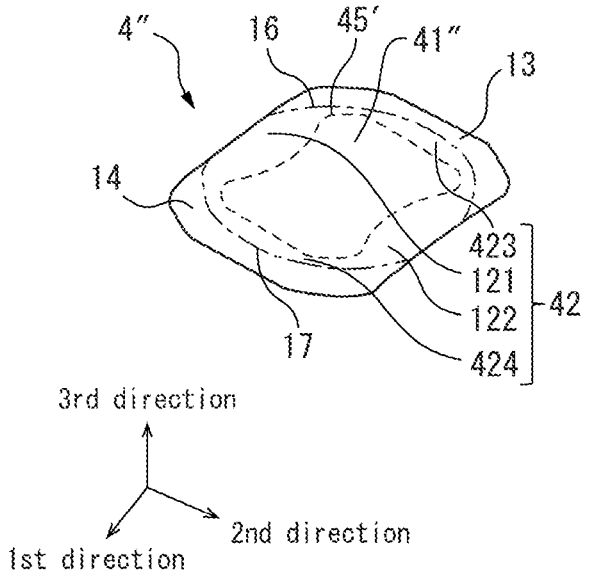
FIG. 21A is a perspective view of a spring according to a ninth modification.
Figure 21B:
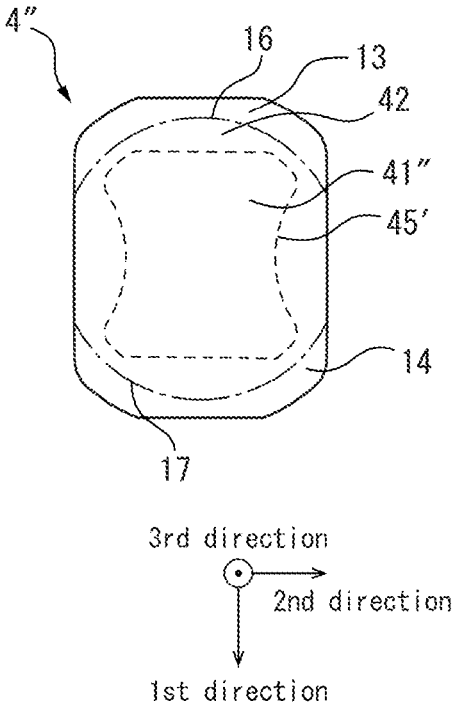
FIG. 21B is a plan view of a spring according to a ninth modification.

FIG. 21A is a perspective view of a spring according to a ninth modification, and FIG. 21B is a plan view of a spring according to a ninth modification.

A spring 4" according to a ninth modification is different from the spring 4 in that the spring 4" has a dome portion 41" instead of the dome portion 41. Since the elements and functions of the components of the spring 4" other than the dome portion 41" are similar to the elements and functions of the components having the same reference numerals of the spring 4, a detailed description thereof will be omitted.

A dome portion 41" is different from the dome portion 41 in that a valley bending portion 45' extends linearly in the lateral direction of the spring 4", and therefore the end in the longitudinal direction of the dome portion 41" has a shape extending linearly in the longitudinal direction. In the manufacturing process of the spring 4", the dome portion 41" is formed by pressing so that the valley bending portion 45' extends linearly in the lateral direction of the spring 4".

Figure 22A:
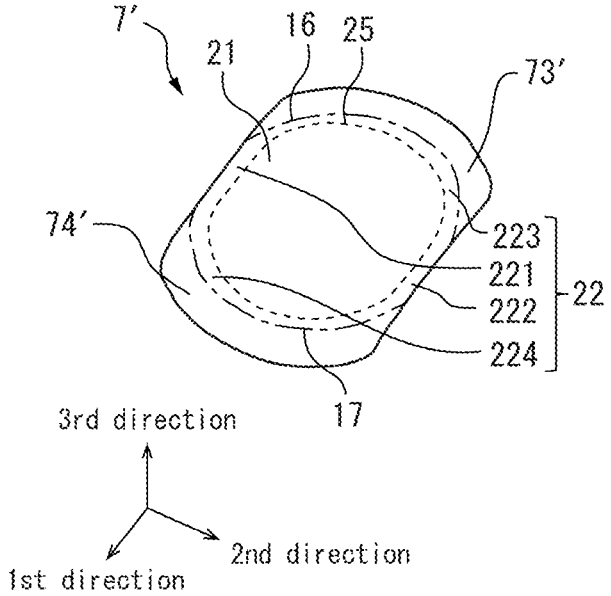
FIG. 22A is a perspective view of a spring according to a tenth modification.
Figure 22B:
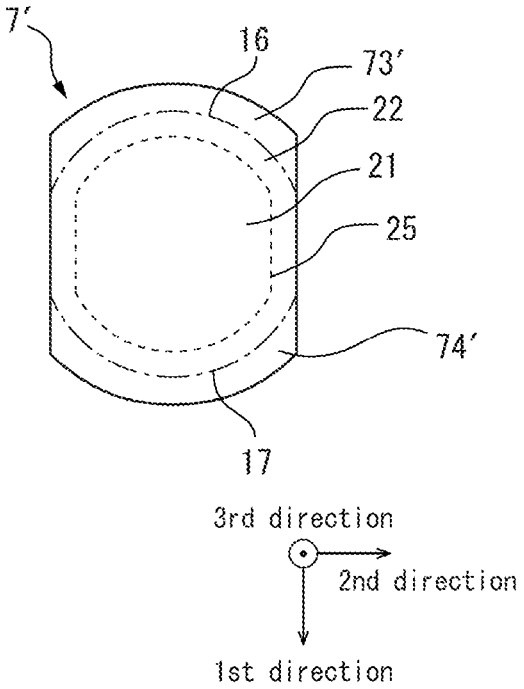
FIG. 22B is a plan view of a spring according to a tenth modification.

FIG. 22A is a perspective view of a spring according to a tenth modification, and FIG. 22B is a plan view of a spring according to a tenth modification.

A spring 7' according to the tenth modification is different from the spring 7 in that the spring 7' has the first support portion 73' and the second support portion 74' instead of the first support portion 73 and the second support portion 74. Since the elements and functions of the components of the spring configuration 7' other than the first support portion 73' and the second support portion 74' are similar to the elements and functions of the components having the same reference numerals of the spring 7, a detailed description thereof will be omitted.

Each of the first support portion 73' and the second support portion 74' is different from the first support portion 73 and the second support portion 74 in that the outer edge extends curved outward. In the manufacturing process of the spring 7', each of the first support portion 73' and the second support portion 74' is formed by pressing so that the outer edges of the first support portion 73' and the second support portion 74' extend curved outward.

Figure 23A:
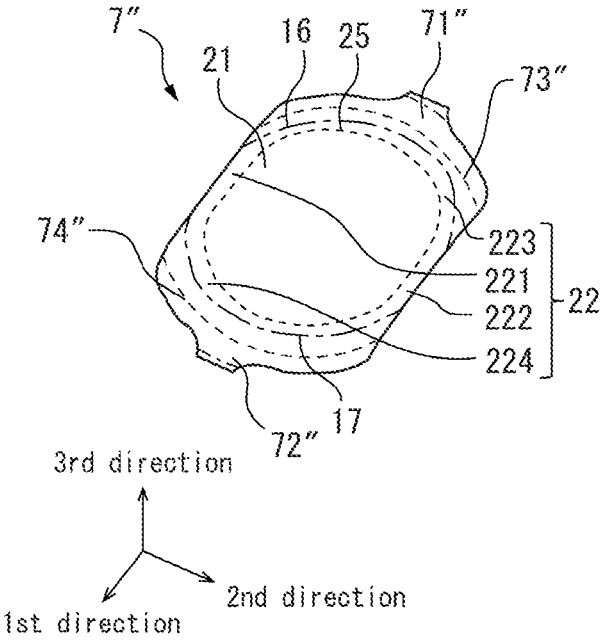
FIG. 23A is a perspective view of a spring according to the eleventh modification.
Figure 23B:
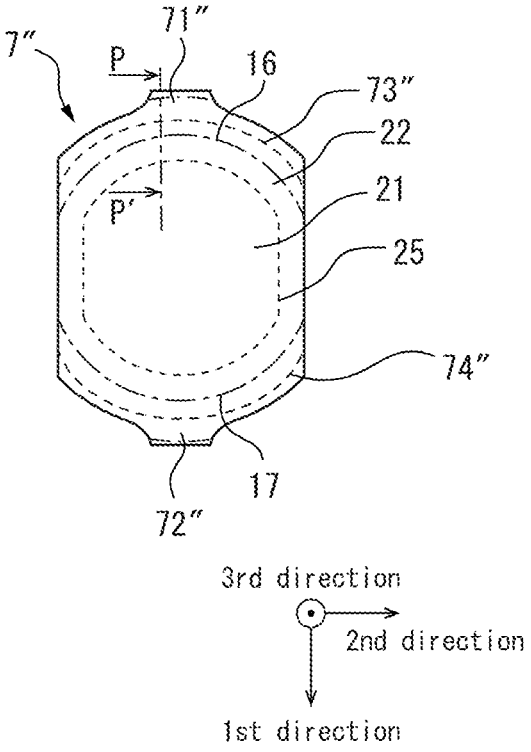
FIG. 23B is a plan view of a spring according to the eleventh modification.
Figure 23C:
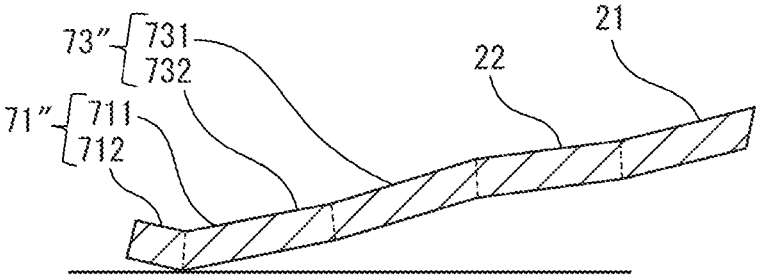
FIG. 23C is a sectional view along the line P-P' shown in FIG. 23B.

FIG. 23A is a perspective view of a spring according to the eleventh modification, FIG. 23B is a plan view of a spring according to the eleventh modification, and FIG. 23C is a cross-sectional view along the line P-P' shown in FIG. 23B.

A spring 7" according to the eleventh modification is different from the spring 7 in that the spring 7" has a first protrusion 71' and a second protrusion 72' instead of the first protrusion 71 and the second protrusion 72. Further, the spring 7" is different from the spring 7 in that the spring 7" has a first support portion 73' and a second support portion 74' instead of the first support portion 73 and the second support portion 74. Since the elements and functions of the components of the spring 7' other than the first protrusion 71', second protrusion 72', the first support portion 73' and the second support portion 74' are similar to the elements and functions of the components having the same reference numerals of the spring 7, a detailed description thereof will be omitted here.

The first protrusion 71" has a first inclined portion 711 and a second inclined portion 712. One end of the first inclined portion 711 is in contact with the first support portion 73", the other end of the first inclined portion 711 is in contact with the second inclined portion 712. A valley bending processing is performed between the first inclined portion 711 and the second inclined portion 712. A fractured surface is formed at the other end of the second inclined portion 712. The second inclined portion 712 may be formed so as to extend in the horizontal direction in order to contact the substrate on which spring 7' is mounted. The second inclined portion 712 may be omitted.

The first support portion 73" has a first inclined portion 731 and a second inclined portion 732. One end of the first inclined portion 731 is in contact with the outer peripheral portion 22, the other end of the first inclined portion 731 is in contact with the second inclined portion 732. A valley bending processing is performed between the first inclined portion 731 and the second inclined portion 732. The other end of the second slope portion 732 forms a surface together with the first inclined portion 711 of the first protrusion 71'. Although a valley bending processing is performed between the first inclined portion 731 and the second inclined portion 732 in the first support portion 73", a crest bending processing may be performed. Further, a flat surface may be formed between the first inclined portion 731 and the second inclined portion 732.

Since the second protrusion 72" and the second support portion 74" has the same configuration as the first protrusion 71" and the first support portion 73", a detailed description thereof will be omitted.

In the spring 7", when the dome portion 21 is pressed, the dome portion 21 is reversed after the first inclined portion 711, the second inclined portion 732 and the first inclined portion 731 are contact with the second fixed contact in sequence. In the spring 7", since the first inclined portion 711, the second inclined portion 732 and the first inclined portion 731 are contact with the second fixed contact in sequential before the dome portion 21 is reversed, the stress generated by the pressing of the dome portion 21 is dispersed between the second inclined portion 732 and the first inclined portion 731.

The spring 7" may extend the life time while maintaining a good click feeling, by dispersing the stress generated by the pressing of the dome portion 21, without concentrating the stress on the valley bending portion 25 forming the outer edge of the dome portion 21.

Figure 24A:
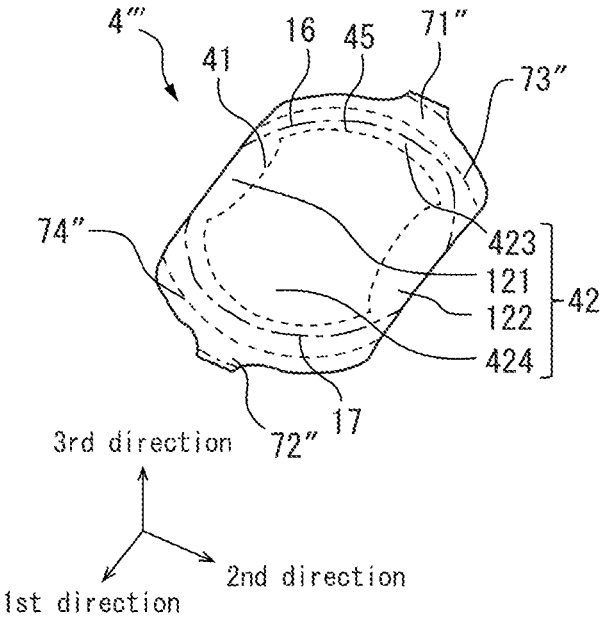
FIG. 24A is a perspective view of a spring according to the twelfth modification.
Figure 24B:
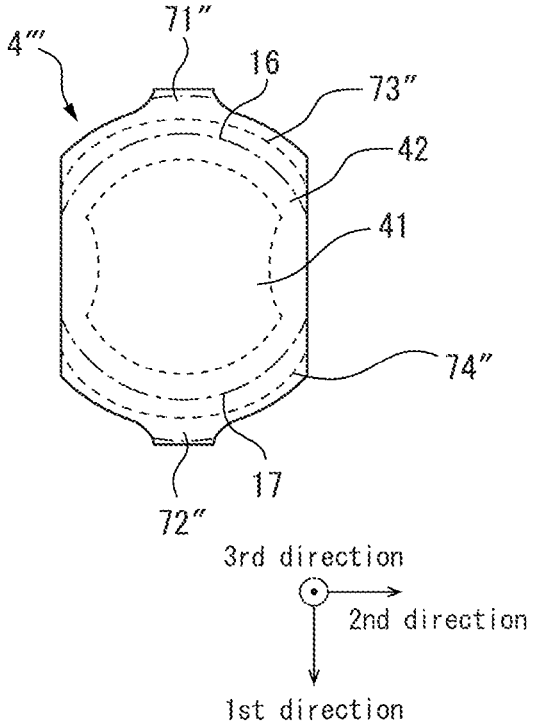
FIG. 24B is a plan view of a spring according to the twelfth modification.
Figure 24C:
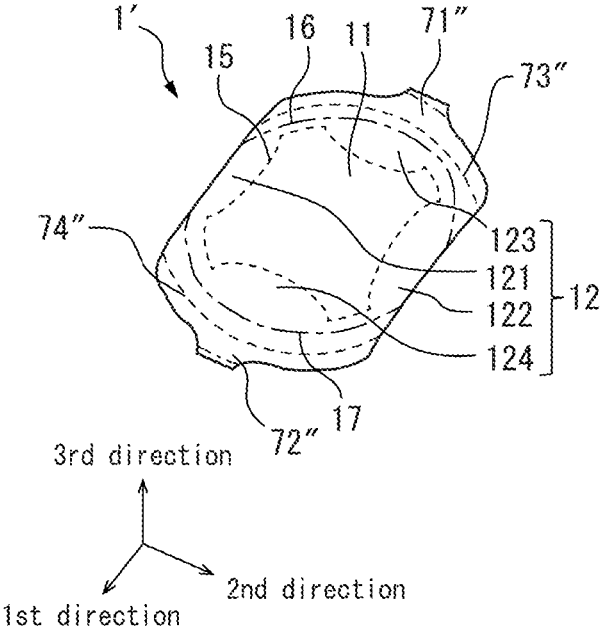
FIG. 24C is a perspective view of a spring according to the thirteenth modification.
Figure 24D:
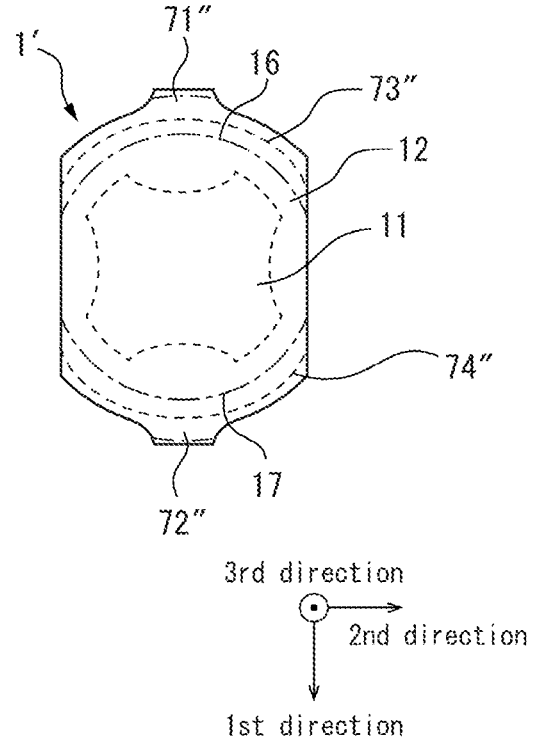
FIG. 24D is a plan view of a spring according to the thirteenth modification.

FIG. 24A is a perspective view of a spring according to a twelfth modification, FIG. 24B is a plan view of a spring according to a twelfth modification, FIG. 24C is a perspective view of a spring according to a thirteenth modification, and FIG. 24D is a plan view of a spring according to a thirteenth modification.

A spring 4'" according to the twelfth modification is different from the spring 4' in that the spring 4'" has a first protrusion 71" and second protrusion 72". Further, the spring 4'" is different from the spring 4' in that the spring 4'" has a first support portion 73' and a second support portion 74' instead of the first support portion 13' and the second support portion 14'. Since the elements and functions of the components of the spring 4'" other than the first protrusion 71", the second protrusion 72", the first support portion 73" and the second support portion 74' are similar to the elements and functions of the components having the same reference numerals of the spring 4', a detailed description thereof will be omitted here.

A spring 1' according to the thirteenth modification is different from the spring 1 in that the spring 1' has a first protrusion 71' and second protrusion 22'. Further, the spring 1' is different from the spring 1 in that the spring 1' has the first support portion 73' and the second support portion 74' instead of the first support portion 13 and the second support portion 14. Since the elements and functions of the components of the spring 1' other than the first protrusion 71' and the second protrusion 72' and the first support portion 73' and the second support portion 74' are similar to the elements and functions of the components having the same reference numerals the spring 1, a detailed description thereof will be omitted here.

Similarly to the spring 7', the spring 1' and the spring 4'" extend the life time while maintaining a good click feeling, by dispersing the stress generated by the pressing of the dome portion 11.

One or more features of the springs 1-8, 9*a* and 9*b* may be optionally combined. Further, in the springs 1 to 8, 9*a* and 9*b*, although the outer peripheral portion is formed so as to extend horizontally, in a spring according to the embodiment, the outer peripheral portion may be formed so as to be inclined. The outer peripheral portion may be formed so that the height in the vertical direction becomes higher as it is spaced from the dome portion, and it may be formed so that the height in the vertical direction becomes lower as it is spaced from the dome portion.

Further, similarly to the spring 6, in the springs 1 and 3 to 5, the outer edges of the first support portion 13 and the second support portion 14 may extend in the longitudinal direction of the spring with curved outward. Further, similarly to the spring 7, in the springs 1 and 3 to 5, the first support portion 13 and the second support portion 14 may have components corresponding to the first protrusion 71 and the second protrusion 72. Further, similarly to the springs 9*a* and 9*b*, in the springs 1 and 3 to 5, a recess or a through hole corresponding to the recess 920 or the through hole 930 may be formed on the dome portion 11, and a plurality of recesses or through holes may be formed thereon.

(Summary of the Features of the Spring According to the Present Disclosure)

Figure 25:
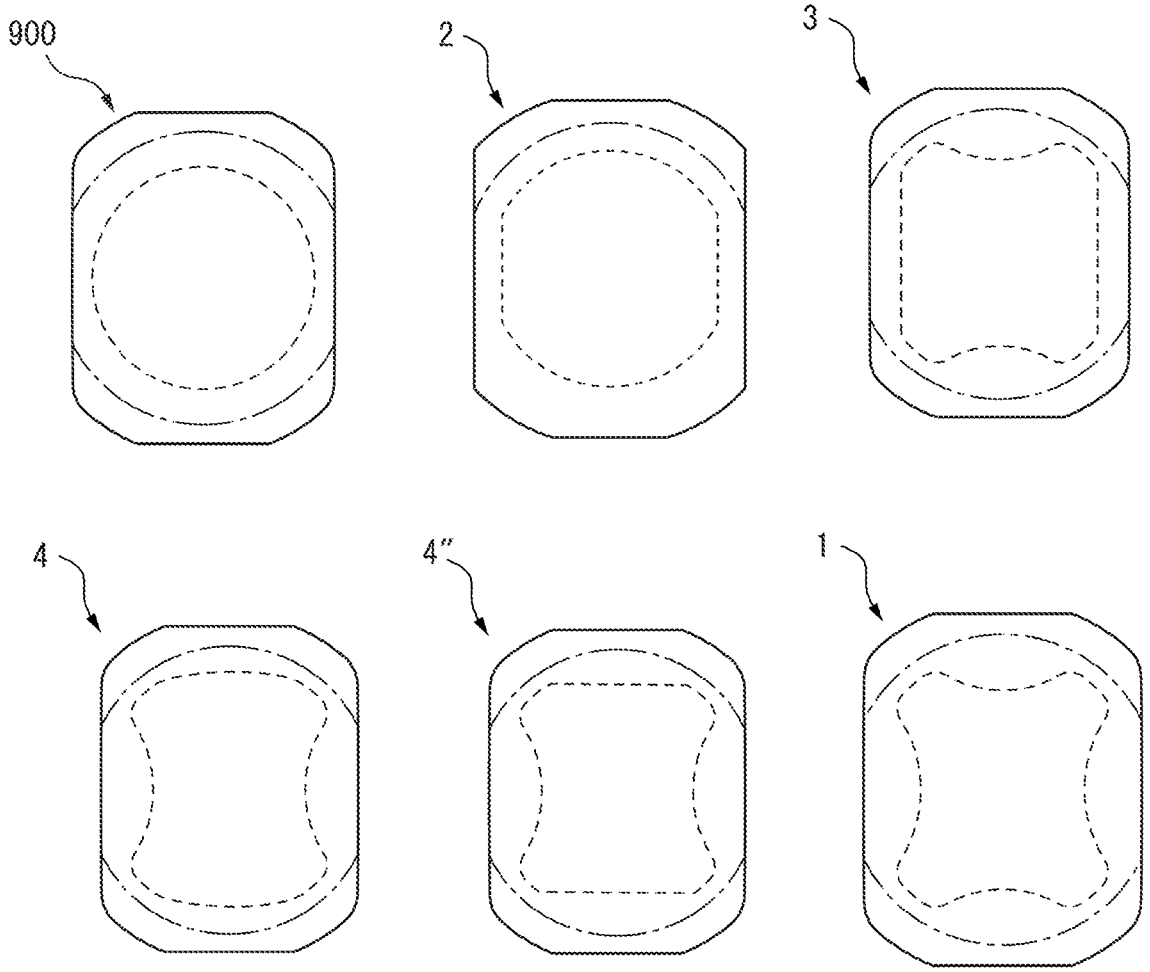
FIG. 25 is a diagram showing a comparison between the spring according to a comparative example and the spring according to the present disclosure (part 1)

FIG. 25 is a diagram showing a comparison between the spring according to the comparative example and the spring according to the present disclosure (part 1).

A straight portion is formed on the outer edge of both longitudinal and direction ends of a spring 900 according to the comparative example. Since the valley bending portion forming the outer edge of the dome portion of the spring 2 according to the present disclosure extends linearly in the longitudinal direction, the distance between the end portion and the dome portion in the lateral direction is longer than that of the spring 900 according to the comparative example, and therefore the spring 2 may have higher durability than the spring 900.

A valley bending portion forming the outer edge of the dome portion of the spring 3 according to the present disclosure is bent inwardly in the lateral direction and stretches. Since the valley bending portion forming the outer edge of the dome portion of the spring 3 is bent inwardly in the lateral direction extends, the distance between the dome portion and the end portion in the longitudinal direction is longer than that of the spring 2 in which a valley bending portion forming the outer edge of the dome portion is bent outwardly in the lateral direction. Since the distance between the dome portion and the end portion in the longitudinal direction of the spring 3 is longer than that of the spring 2, the spring 3 may have higher durability than the spring 2.

The valley bends forming the outer edge of the dome portion of the spring 4 according to the present disclosure extend longitudinally curved inwardly. Since the valley bending portion forming the outer edge of the dome portion of the spring 4 is bent inwardly in a longitudinal direction distance, the portion where the distance between the outer edge and the dome portion of the spring 4 is long may be longer than that of the spring 3. Since the portion where the distance between the outer edge and the dome portion of the spring 4 is longer than that of the spring 3, the spring 4 may have higher durability than the spring 3.

The valley bending portion forming the outer edge of the dome portion of spring 4" according to the present disclosure extends linearly in the lateral direction. Since the valley bending portion forming the outer edge of the dome portion of the spring 4" extends linearly in the lateral direction, the distance between the end portion and the dome portion in the lateral direction is longer than that of the spring 4 in which the valley bending portion forming the outer edge of the dome portion of the spring 4 is curved outward in the lateral direction. Since the distance between the end portion and the dome portion of the spring 4" in the lateral direction is longer than that of the spring 2, the spring 4" may have higher durability than the spring 4.

The valley bending portion forming the outer edge of the dome portion of the spring 1 according to the present disclosure extends curved inward in the lateral direction. Since the valley bending portion forming the outer edge of the dome portion of the spring 1 extends curved inwardly in the lateral direction, the distance between the end portion and the dome portion of the spring 1 in the lateral direction is longer than that of the spring 4" in which valley bending portion forming the outer edge of the dome portion of the spring 4" is linearly in the lateral direction. Since the distance between the longitudinal end and the dome portion of the spring 1 is longer than that of the spring 4', the spring 1 may have higher durability than the spring 4".

Figure 26:
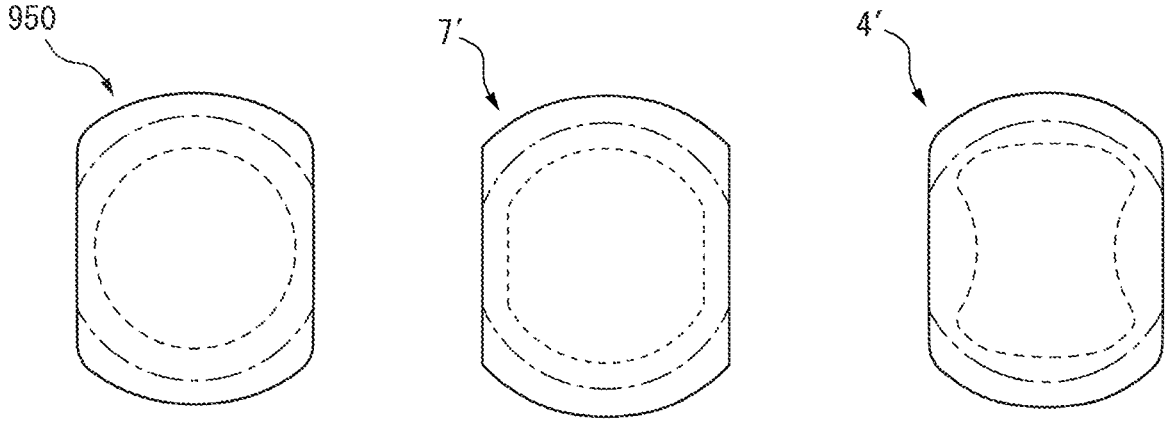
FIG. 26 is a diagram showing a comparison between the spring according to the comparative example and the spring according to the present disclosure (part 2).

FIG. 26 is a figure showing a comparison between the spring according to the comparative example and the spring according to the present disclosure (part 2).

In a spring 950 according to the comparative example, a straight portion is formed on the outer edge of only the end portion in the longitudinal direction, and the outer edge of the end portion in the longitudinal direction has a planar shape curved outward.

Since the valley bending portion forming the outer edge of the dome portion of the spring 7' according to the present disclosure extends linearly in the longitudinal direction, the distance between the end portion and the dome portion of the spring 7' in the lateral direction is longer than that of the spring 950 according to the comparative example, and therefore the spring 7' may have higher durability than the spring 950.

The valley bend forming the outer edge of the dome portion of the spring 4'" is bent inwardly in the longitudinal direction. Since the valley bending portion forming the outer edge of the dome portion of the spring 4' is bent inwardly in the longitudinal direction, the distance between the end portion and the dome portion of the spring 4' in the transverse direction is longer than that of the spring 7' in which valley bending portion forming the outer edge of the dome portion of the spring 7' extends linearly in the longitudinal direction. Since the distance between the end portion and the dome portion of the spring 4' in the lateral direction is longer than that of the spring 7', the spring 4' may have higher durability than the spring 7'.

What is claimed is:

1. A spring comprising:

a dome portion having a dome shape bulging convexly toward the upward;

an outer peripheral portion disposed along an entire periphery of the dome portion;

first and second support portions disposed at both ends of the outer peripheral portion;

a valley bending portion disposed between the dome portion and the outer peripheral portion, and bent concavely upward;

a first crest bending portion disposed between the outer peripheral portion and the first support portion, and bent convexly upward; and a second crest bending portion disposed between the outer peripheral portion and the second support portion, and bent convexly upward, wherein the outer peripheral portion includes first and second side end portions which are not connected with the first and second support portions, and the valley bending portion disposed between the dome portion and the first and second side end portions extends linearly or curved inwardly in a longitudinal direction.

2. The spring according to claim 1, wherein outer edges of the first and second side end portions extend linearly or curved outwardly in a longitudinal direction, and when the outer edges of the first and second side end portions extend curved outwardly, curvatures of the outer edges of the first and second side end portions are larger than a curvature of the virtual circle in contact with at least 3 points of are outer edge of the spring.

3. The spring according to claim 2, wherein the valley bending portion is disposed between the dome portion and the first and second side end portions extends linearly in a longitudinal direction.

4. The spring according to claim 2, wherein the valley bending portion is disposed between the dome portion and the first and second side end portions extends curved inwardly in a longitudinal direction.

5. The spring according to claim 3, wherein the outer edges of the first and second side end portions extend linearly in a longitudinal direction of the spring.

6. The spring according to claim 5, wherein the valley bending portion is disposed between the dome portion and the first and second side end portions extends curved outwardly in the lateral direction of the spring.

7. The spring according to claim 5, wherein the valley bending portion is disposed between the dome portion and the first and second side end portions extends linearly in the lateral direction of the spring.

8. The spring according to claim 5, wherein the valley bending portion disposed between the dome portion and the first and second side end portions extends is curved inwardly in the lateral direction of the spring.

9. The spring according to claim 8, wherein the dome portion has a planar shape in which the end portions of straight lines forming a cross are connected by curves that curve inwardly.

10. The spring according to claim 1, wherein the valley bending portion includes lateral extensions extending in a lateral direction and longitudinal extensions extending in the longitudinal direction, and the lateral extensions extending and the longitudinal extensions are not connected each other.

11. The spring according to claim 1, wherein the first and second support portions are disposed at both ends of the longitudinal direction of the spring, and the first and second side end portions are at the ends of the lateral direction of the spring.

12. The spring according to claim 1, wherein each of the first and second support portions has a protrusion disposed at an end of the longitudinal direction of the spring.

13. The spring according to claim 1, wherein a recess is formed on the dome portion.

14. The spring according to claim 1, wherein a through hole is formed on the dome portion.

15. A switch comprising:

a substrate;

a first fixed contact disposed on the surface;

a second fixed contact disposed so as to surround the first fixed contact;

a spring disposed above the first fixed contact, and in contact with the second fixed contact at the longitudinal ends;

a case disposed on the substrate, and formed a housing portion with the substrate in which the first fixed contact, the second fixed contact, the spring and presser are put; and a protective cover adhered to the surface of the case so as to cover the housing portion, wherein the spring has a dome portion having a dome shape bulging convexly toward the upward, an outer peripheral portion disposed along an entire periphery of the dome portion, a first support portion and a second support portion disposed at both ends of the outer peripheral portion, a valley bending portion disposed between the dome portion and the outer peripheral portion, and bent concavely upward, a first crest bending portion disposed between the outer peripheral portion and the first support portion, and bent convexly upward, and a second crest bending portion disposed between the outer peripheral portion and the second support portion, and bent convexly upward, wherein the outer peripheral portion includes a first side end portion and a second side end portion which are not connected with the first support portion and second support portion, and the valley bending portion disposed between the dome portion and the first and second side end portions extends linearly or curved inwardly in a longitudinal direction.

* * * * *